US011512876B2

(12) United States Patent
Takegami et al.

(10) Patent No.: US 11,512,876 B2
(45) Date of Patent: Nov. 29, 2022

(54) REFRIGERATION APPARATUS

(71) Applicant: DAIKIN INDUSTRIES, LTD., Osaka (JP)

(72) Inventors: Masaaki Takegami, Osaka (JP); Shuichi Taguchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/684,720

(22) Filed: Mar. 2, 2022

(65) Prior Publication Data

US 2022/0186988 A1 Jun. 16, 2022

Related U.S. Application Data

(63) Continuation of application No. PCT/JP2020/025239, filed on Jun. 26, 2020.

(30) Foreign Application Priority Data

Sep. 30, 2019 (JP) ..... JP2019-180544

(51) Int. Cl.
*F25B 1/10* (2006.01)
*F25B 13/00* (2006.01)
*F25B 43/00* (2006.01)

(52) U.S. Cl.
CPC ..... *F25B 1/10* (2013.01); *F25B 13/00* (2013.01); *F25B 43/00* (2013.01); *F25B 2313/02334* (2013.01); *F25B 2400/19* (2013.01)

(58) Field of Classification Search
CPC .. F25B 1/10; F25B 13/00; F25B 43/00; F25B 2313/02334; F25B 2400/19
See application file for complete search history.

(56) References Cited

U.S. PATENT DOCUMENTS

2014/0260341 A1* 9/2014 Vaisman ..... B64D 13/006 62/208
2017/0010030 A1* 1/2017 Tanaka ..... F25B 49/02
2019/0154322 A1 5/2019 Ito et al.

FOREIGN PATENT DOCUMENTS

EP 3 203 163 A1 8/2017
JP 2011-133205 A 7/2011
(Continued)

OTHER PUBLICATIONS

International Search Report, issued in PCT/JP2020/025239, dated Sep. 15, 2020.
(Continued)

*Primary Examiner* — Henry T Crenshaw
(74) *Attorney, Agent, or Firm* — Birch, Stewart, Kolasch & Birch, LLP

(57) ABSTRACT

A refrigeration apparatus includes a heat source-side unit and a utilization-side unit that are connected to each other, and performs a refrigeration cycle in which a high pressure of a refrigerant reaches or exceeds a critical pressure. The refrigeration apparatus also includes a control unit configured to perform a first action of returning the refrigerant to the heat source-side unit when a stop condition of the utilization-side unit is satisfied, and a second action of prohibiting the first action when a pressure at the heat source-side unit is equal to or more than the critical pressure of the refrigerant. This configuration suppresses damage to a refrigerant storage reservoir and the like in returning the refrigerant to the heat source-side unit.

8 Claims, 11 Drawing Sheets

(56) References Cited

FOREIGN PATENT DOCUMENTS

| | | | |
|---|---|---|---|
| JP | 2013-108646 | A | 6/2013 |
| JP | 2018-9767 | A | 1/2018 |
| WO | WO 2006/115051 | A1 | 11/2006 |
| WO | WO 2008/069265 | A1 | 6/2008 |
| WO | WO 2017/061010 | A1 | 4/2017 |
| WO | WO 2017/138419 | A1 | 8/2017 |

OTHER PUBLICATIONS

Written Opinion of the International Searching Authority, issued in PCT/JP2020/025239, dated Sep. 15, 2020.
English translation of International Preliminary Report on Patentability and Written Opinion of the International Searching Authority for International Application No. PCTJP2020/025239, dated Apr. 14, 2022.
Extended European Search Report for European Application No. 20871746.2 dated Sep. 12, 2022.

* cited by examiner

REFRIGERATION APPARATUS

CROSS REFERENCE TO RELATED APPLICATIONS

This application is a Continuation of PCT International Application No. PCT/JP2020/025239, filed on Jun. 26, 2020, which claims priority 35 U.S.C. 119(a) to Patent Application No. 2019-180544, filed in Japan on Sep. 30, 2019, all of which are hereby expressly incorporated by reference into the present application.

TECHNICAL FIELD

The present disclosure relates to a refrigeration apparatus.

BACKGROUND ART

There are refrigeration apparatuses including a heat source-side unit installed outdoors, the heat source-side including a gas-liquid separator (a refrigerant storage reservoir), and a utilization-side unit connected to the heat source-side unit. As disclosed in, for example, Patent Literature 1, in some of these refrigeration apparatuses, a refrigerant in a refrigerant circuit is returned to a refrigerant storage reservoir or a heat source-side heat exchanger of a heat source-side unit in stopping an action of a utilization-side unit.

CITATION LIST

Patent Literature

Patent Literature 1: JP 2018-009767 A

SUMMARY

A first aspect of the present disclosure is based on a refrigeration apparatus including a refrigerant circuit (6) including a heat source-side unit (10) installed outdoors, and a utilization-side unit (50) connected to the heat source-side unit (10), the refrigerant circuit (6) being configured to perform a refrigeration cycle in which a high pressure reaches or exceeds a critical pressure of the refrigerant.

The first aspect includes a control unit (100) configured to control an action of the refrigerant circuit (6).

The control unit (100) is also configured to perform a first action of recovering at least a part of the refrigerant from the utilization-side unit (50) and returning the refrigerant thus recovered to the heat source-side unit (10) in a case where a stop condition of the utilization-side unit (50) is satisfied, and a second action of prohibiting the first action in a case where a first condition indicating that a pressure at the heat source-side unit (10) is equal to or more than the critical pressure of the refrigerant is satisfied.

The heat source-side unit (10) includes a radiator (13) and a refrigerant storage reservoir (15).

The control unit (100) performs the second action in a case where a predetermined condition indicating that a pressure at the refrigerant storage reservoir (15) is equal to or more than the critical pressure of the refrigerant is satisfied as the first condition.

DESCRIPTION OF EMBODIMENTS

Embodiments will be described below with reference to the drawings. The following embodiments are preferable examples in nature and are not intended to limit the scope of the present invention, products to which the present invention is applied, or the use of the present invention.

<<Embodiment>>

<General Configuration>

A refrigeration apparatus (1) according to an embodiment is configured to cool a cooling target and to condition indoor air. The term "cooling target" as used herein may involve air in a refrigeration facility such as a refrigerator, a freezer, or a showcase. In the following description, such a facility is referred to as a cooling facility.

Figure 1:
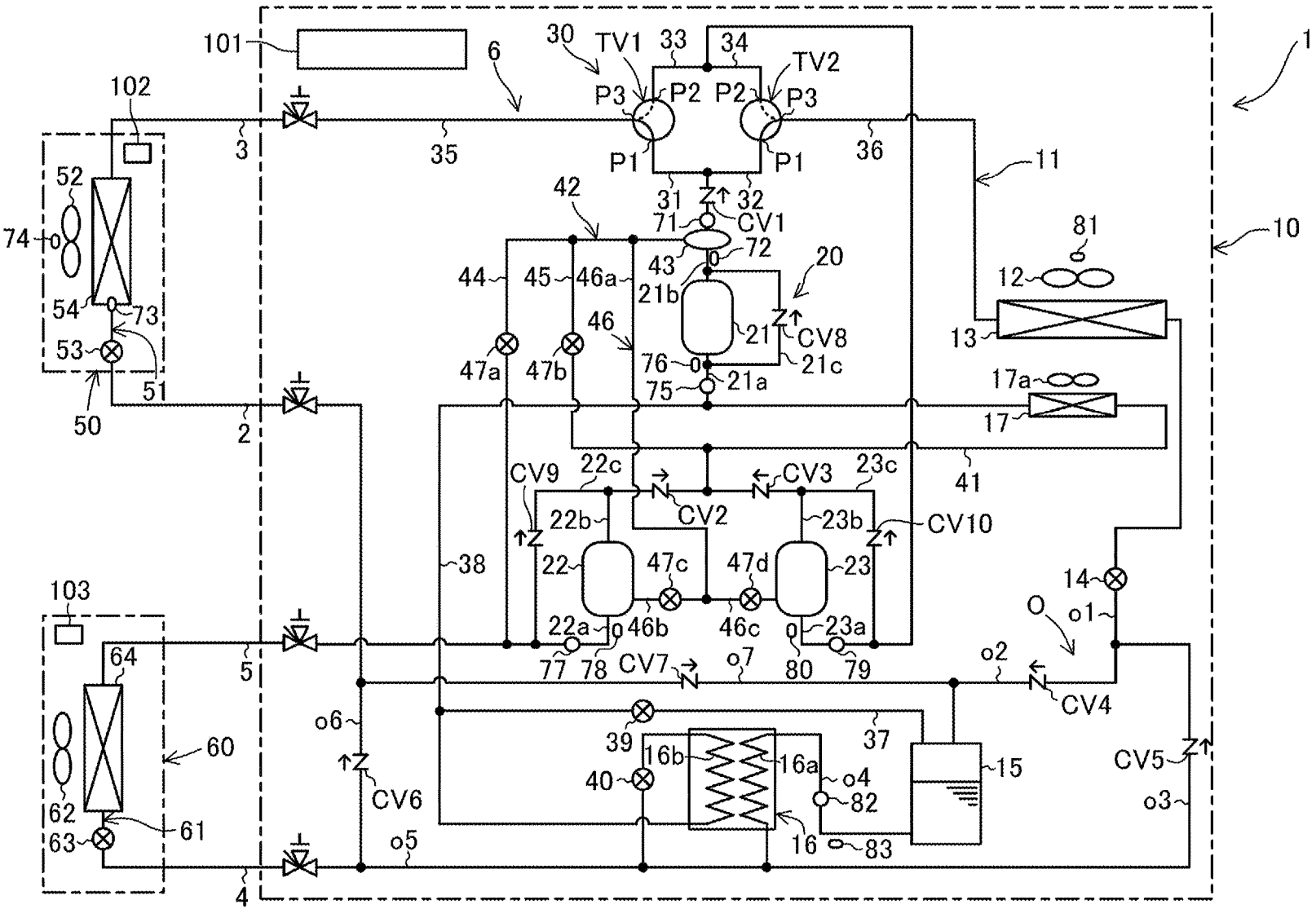
FIG. 1 is a diagram of a piping system in a refrigeration apparatus according to an embodiment.

As illustrated in FIG. 1, the refrigeration apparatus (1) includes an outdoor unit (10) installed outdoors, an indoor unit (50) configured to condition indoor air, a cooling facility unit (60) configured to cool inside air, and a controller (100). The refrigeration apparatus (1) illustrated in FIG. 1 includes one indoor unit (50). The refrigeration apparatus (1) may alternatively include a plurality of indoor units (50) connected in parallel. The refrigeration apparatus (1) illustrated in FIG. 1 includes one cooling facility unit (60). The refrigeration apparatus (1) may alternatively include a plurality of cooling facility units (60) connected in parallel. In this embodiment, these units (10, 50, 60) are connected via four connection pipes (2, 3, 4, 5) to constitute a refrigerant circuit (6).

The four connection pipes (2, 3, 4, 5) include a first liquid connection pipe (2), a first gas connection pipe (3), a second liquid connection pipe (4), and a second gas connection pipe (5). The first liquid connection pipe (2) and the first gas connection pipe (3) are provided for the indoor unit (50). The second liquid connection pipe (4) and the second gas connection pipe (5) are provided for the cooling facility unit (60).

A refrigeration cycle is achieved in such a manner that a refrigerant circulates through the refrigerant circuit (6). In this embodiment, the refrigerant in the refrigerant circuit (6) is carbon dioxide. The refrigerant circuit (6) is configured to perform a refrigeration cycle in which a pressure above a critical pressure is applied to the refrigerant.

<Outdoor Unit>

The outdoor unit (10) is a heat source-side unit to be installed outdoors. The outdoor unit (10) includes an outdoor fan (12) and an outdoor circuit (11). The outdoor circuit (11) includes a compression unit (20), a flow path switching mechanism (30), an outdoor heat exchanger (13), an outdoor expansion valve (14), a gas-liquid separator (15), a cooling heat exchanger (16), and an intermediate heat exchanger (17).

<Compression Unit>

The compression unit (20) is configured to compress the refrigerant. The compression unit (20) includes a first compressor (21), a second compressor (22), and a third compressor (23). The compression unit (20) is of a two-stage compression type. The second compressor (22) and the third compressor (23) constitute a lower-stage compression element configured to compress the refrigerant. The second compressor (22) and the third compressor (23) are connected in parallel. The first compressor (21) constitutes a higher-stage compression element configured to further compress the refrigerant compressed by the lower-stage compression element. The first compressor (21) and the second compressor (22) are connected in series. The first compressor (21) and the third compressor (23) are connected in series. Each of the first compressor (21), the second compressor (22), and the third compressor (23) is a rotary compressor that includes a compression mechanism to be driven by a motor. Each of the first compressor (21), the second compressor (22), and the third compressor (23) is of a variable capacity type, and the operating frequency or the number of rotations of each compressor is adjustable.

A first suction pipe (21*a*) and a first discharge pipe (21*b*) are connected to the first compressor (21). A second suction pipe (22*a*) and a second discharge pipe (22*b*) are connected to the second compressor (22). A third suction pipe (23*a*) and a third discharge pipe (23*b*) are connected to the third compressor (23).

A first bypass passage (21*c*) is connected to the first suction pipe (21*a*) and the first discharge pipe (21*b*), for bypassing the first compressor (21). A second bypass passage (22*c*) is connected to the second suction pipe (22*a*) and the second discharge pipe (22*b*), for bypassing the second compressor (22). A third bypass passage (23*c*) is connected to the third suction pipe (23*a*) and the third discharge pipe (23*b*), for bypassing the third compressor (23).

The second suction pipe (22*a*) communicates with the cooling facility unit (60). The second compressor (22) is a cooling facility-side compressor provided for the cooling facility unit (60). The third suction pipe (23*a*) communicates with the indoor unit (50). The third compressor (23) is an indoor-side compressor provided for the indoor unit (50).

<Flow Path Switching Mechanism>

The flow path switching mechanism (30) is configured to switch a refrigerant flow path. The flow path switching mechanism (30) includes a first pipe (31), a second pipe (32), a third pipe (33), a fourth pipe (34), a first three-way valve (TV1), and a second three-way valve (TV2). The first pipe (31) has an inlet end connected to the first discharge pipe (21*b*). The second pipe (32) has an inlet end connected to the first discharge pipe (21*b*). Each of the first pipe (31) and the second pipe (32) is a pipe on which a discharge pressure of the compression unit (20) acts. The third pipe (33) has an outlet end connected to the third suction pipe (23*a*) of the third compressor (23). The fourth pipe (34) has an outlet end connected to the third suction pipe (23*a*) of the third compressor (23). Each of the third pipe (33) and the fourth pipe (34) is a pipe on which a suction pressure of the compression unit (20) acts.

The first three-way valve (TV1) has a first port (P1), a second port (P2), and a third port (P3). The first port (P1) of the first three-way valve (TV1) is connected to an outlet end of the first pipe (31) serving as a high-pressure flow path. The second port (P2) of the first three-way valve (TV1) is connected to an inlet end of the third pipe (33) serving as a low-pressure flow path. The third port (P3) of the first three-way valve (TV1) is connected to an indoor gas-side flow path (35).

The second three-way valve (TV2) has a first port (P1), a second port (P2), and a third port (P3). The first port (P1) of the second three-way valve (TV2) is connected to an outlet end of the second pipe (32) serving as a high-pressure flow path. The second port (P2) of the second three-way valve (TV2) is connected to an inlet end of the fourth pipe (34) serving as a low-pressure flow path. The third port (P3) of the second three-way valve (TV2) is connected to an outdoor gas-side flow path (36).

Each of the first three-way valve (TV1) and the second three-way valve (TV2) is an electrically driven three-way valve. Each three-way valve (TV1, TV2) is switched to a first state (a state indicated by a solid line in FIG. 1) and a second state (a state indicated by a broken line in FIG. 1). In each three-way valve (TV1, TV2) switched to the first state, the first port (P1) and the third port (P3) communicate with each other and the second port (P2) is closed. In each three-way valve (TV1, TV2) switched to the second state, the second port (P2) and the third port (P3) communicate with each other and the first port (P1) is closed.

<Outdoor Heat Exchanger>

The outdoor heat exchanger (13) serves as a heat source-side heat exchanger. The outdoor heat exchanger (13) is a fin-and-tube air heat exchanger. The outdoor fan (12) is disposed near the outdoor heat exchanger (13). The outdoor fan (12) is configured to provide outdoor air. The outdoor heat exchanger causes the refrigerant flowing therethrough to exchange heat with the outdoor air provided by the outdoor fan (12).

The outdoor heat exchanger (13) has a gas end to which the outdoor gas-side flow path (36) is connected. The outdoor heat exchanger (13) has a liquid end to which an outdoor flow path (0) is connected.

<Outdoor Flow Path>

The outdoor flow path (O) includes an outdoor first pipe (o1), an outdoor second pipe (o2), an outdoor third pipe (o3), an outdoor fourth pipe (o4), an outdoor fifth pipe (o5), an outdoor sixth pipe (o6), and an outdoor seventh pipe (o7). The outdoor first pipe (o1) has a first end connected to the liquid end of the outdoor heat exchanger (13). The outdoor first pipe (o1) has a second end to which a first end of the outdoor second pipe (o2) and a first end of the outdoor third pipe (o3) are connected. The outdoor second pipe (o2) has a second end connected to a top portion of the gas-liquid separator (15). The outdoor fourth pipe (o4) has a first end connected to a bottom portion of the gas-liquid separator (15). The outdoor fourth pipe (o4) has a second end to which a first end of the outdoor fifth pipe (o5) and a second end of the outdoor third pipe (o3) are connected. The outdoor fifth pipe (o5) has a second end connected to the second liquid connection pipe (4). The outdoor sixth pipe (o6) has a first end connected to a point between the two ends of the outdoor fifth pipe (o5). The outdoor sixth pipe (o6) has a second end connected to the first liquid connection pipe (2). The outdoor seventh pipe (o7) has a first end connected to a point between the two ends of the outdoor sixth pipe (o6). The outdoor seventh pipe (o7) has a second end connected to a point between the two ends of the outdoor second pipe (o2).

<Outdoor Expansion Valve>

The outdoor expansion valve (14) is connected to the outdoor first pipe (o1). The outdoor expansion valve (14) is located at a refrigerant path between the gas-liquid separator (15) and the outdoor heat exchanger (13) functioning as a radiator when a utilization-side heat exchanger (54, 64) functions as an evaporator. The outdoor expansion valve (14) is a decompression mechanism configured to decompress the refrigerant. The outdoor expansion valve (14) is a heat source-side expansion mechanism. The outdoor expansion valve (14) is an opening degree-adjustable electronic expansion valve.

<Gas-Liquid Separator>

The gas-liquid separator (15) serves as a container for storing the refrigerant (i.e., a refrigerant storage reservoir). The gas-liquid separator (15) is disposed downstream of the radiator (13, 54) in the refrigerant circuit. The gas-liquid separator (15) separates the refrigerant into the gas refrigerant and the liquid refrigerant. The gas-liquid separator (15) has the top portion to which the second end of the outdoor second pipe (o2) and a first end of a degassing pipe (37) are connected. The degassing pipe (37) has a second end connected to a point between two ends of an injection pipe (38). A degassing valve (39) is connected to the degassing pipe (37). The degassing valve (39) is an opening degree-changeable electronic expansion valve.

<Cooling Heat Exchanger>

The cooling heat exchanger (16) is configured to cool the refrigerant (mainly the liquid refrigerant) separated by the gas-liquid separator (15). The cooling heat exchanger (16) includes a first refrigerant flow path (16*a*) and a second refrigerant flow path (16*b*). The first refrigerant flow path (16*a*) is connected to a point between the two ends of the outdoor fourth pipe (o4). The second refrigerant flow path (16*b*) is connected to a point between the two ends of the injection pipe (38).

The injection pipe (38) has a first end connected to a point between the two ends of the outdoor fifth pipe (o5). The injection pipe (38) has a second end connected to the first suction pipe (21*a*) of the first compressor (21). In other words, the injection pipe (38) has a second end connected to an intermediate-pressure portion of the compression unit (20). The injection pipe (38) is provided with a reducing valve (40) located upstream of the second refrigerant flow path (16*b*). The reducing valve (40) is an opening degree-changeable expansion valve.

The cooling heat exchanger (16) causes the refrigerant flowing through the first refrigerant flow path (16*a*) to exchange heat with the refrigerant flowing through the second refrigerant flow path (16*b*). The refrigerant decompressed by the reducing valve (40) flows through the second refrigerant flow path (16*b*). Therefore, the cooling heat exchanger (16) cools the refrigerant flowing through the first refrigerant flow path (16*a*).

<Intermediate Heat Exchanger>

The intermediate heat exchanger (17) is connected to an intermediate flow path (41). The intermediate flow path (41) has a first end connected to the second discharge pipe (22*b*) connected to the second compressor (22) and the third discharge pipe (23*b*) connected to the third compressor (23). The intermediate flow path (41) has a second end connected to the first suction pipe (21*a*) connected to the first compressor (21). In other words, the intermediate flow path (41) has a second end connected to the intermediate-pressure portion of the compression unit (20).

The intermediate heat exchanger (17) is a fin-and-tube air heat exchanger. A cooling fan (17*a*) is disposed near the intermediate heat exchanger (17). The intermediate heat exchanger (17) causes the refrigerant flowing therethrough to exchange heat with outdoor air provided by the cooling fan (17*a*).

The intermediate heat exchanger (17) functions as a cooler that cools the refrigerant discharged from the lower-stage compression element (22, 23) and supplies the refrigerant thus cooled to the higher-stage compression element (21) for the two-stage compression by the compression unit (20).

<Oil Separation Circuit>

The outdoor circuit (11) includes an oil separation circuit (42). The oil separation circuit (42) includes an oil separator (43), a first oil return pipe (44), a second oil return pipe (45), and a third oil return pipe (46). The oil separator (43) is connected to the first discharge pipe (21*b*) connected to the first compressor (21). The oil separator (43) is configured to separate oil from the refrigerant discharged from the compression unit (20). The first oil return pipe (44) has an inlet end communicating with the oil separator (43). The first oil return pipe (44) has an outlet end connected to the second suction pipe (22*a*) connected to the second compressor (22). The second oil return pipe (45) has an inlet end communicating with the oil separator (43). The second oil return pipe (45) has an outlet end connected to an inlet end of the intermediate flow path (41). The third oil return pipe (46) includes a main return pipe (46*a*), a cooling facility-side branch pipe (46*b*), and an indoor-side branch pipe (46*c*). The main return pipe (46*a*) has an inlet end communicating with the oil separator (43). The main return pipe (46*a*) has an outlet end to which an inlet end of the cooling facility-side branch pipe (46*b*) and an inlet end of the indoor-side branch pipe (46*c*) are connected. The cooling facility-side branch pipe (46*b*) has an outlet end communicating with an oil reservoir in a casing of the second compressor (22). The indoor-side branch pipe (46*c*) has an outlet end communicating with an oil reservoir in a casing of the third compressor (23).

A first oil regulation valve (47*a*) is connected to the first oil return pipe (44). A second oil regulation valve (47*b*) is connected to the second oil return pipe (45). A third oil regulation valve (47*c*) is connected to the cooling facility-side branch pipe (46*b*). A fourth oil regulation valve (47*d*) is connected to the indoor-side branch pipe (46*c*).

The oil separated by the oil separator (43) is returned to the second compressor (22) via the first oil return pipe (44). The oil separated by the oil separator (43) is returned to the third compressor (23) via the second oil return pipe (45). The oil separated by the oil separator (43) is returned to the oil reservoir in the casing of each of the second compressor (22) and the third compressor (23) via the third oil return pipe (46).

<Check Valve>

The outdoor circuit (11) includes a first check valve (CV1), a second check valve (CV2), a third check valve (CV3), a fourth check valve (CV4), a fifth check valve (CV5), a sixth check valve (CV6), a seventh check valve (CV7), an eighth check valve (CV8), a ninth check valve (CV9), and a tenth check valve (CV10). The first check valve (CV1) is connected to the first discharge pipe (21*b*). The second check valve (CV2) is connected to the second discharge pipe (22*b*). The third check valve (CV3) is connected to the third discharge pipe (23*b*). The fourth check valve (CV4) is connected to the outdoor second pipe (o2). The fifth check valve (CV5) is connected to the outdoor third pipe (o3). The sixth check valve (CV6) is connected to the outdoor sixth pipe (o6). The seventh check valve (CV7) is connected to the outdoor seventh pipe (o7). The eighth check valve (CV8) is connected to the first bypass passage (21*c*). The ninth check valve (CV9) is connected to the second bypass passage (22*c*). The tenth check valve (CV10) is connected to the third bypass passage (23*c*). These check valves (CV1 to CV10) each allow the flow of the refrigerant in a direction indicated by an arrow in FIG. 1 and prohibit the flow of the refrigerant in the opposite direction to the direction indicated by the arrow in FIG. 1.

<Indoor Unit>

The indoor unit (50) is a utilization-side unit to be installed indoors. The indoor unit (50) includes an indoor fan (52) and an indoor circuit (51). The indoor circuit (51) has a liquid end to which the first liquid connection pipe (2) is connected. The indoor circuit (51) has a gas end to which the first gas connection pipe (3) is connected.

The indoor circuit (51) includes an indoor expansion valve (53) and an indoor heat exchanger (54) arranged in this order from the liquid end toward the gas end. The indoor expansion valve (53) is a first utilization-side expansion mechanism. The indoor expansion valve (53) is an opening degree-changeable electronic expansion valve.

The indoor heat exchanger (54) is a first utilization-side heat exchanger. The indoor heat exchanger (54) is a fin-and-tube air heat exchanger. The indoor fan (52) is disposed near the indoor heat exchanger (54). The indoor fan (52) is configured to provide indoor air. The indoor heat exchanger (54) causes the refrigerant flowing therethrough to exchange heat with the indoor air provided by the indoor fan (52).

<Cooling Facility Unit>

The cooling facility unit (60) is a utilization-side unit configured to cool the inside of the refrigeration facility. The cooling facility unit (60) includes a cooling facility fan (62) and a cooling facility circuit (61). The cooling facility circuit (61) has a liquid end to which the second liquid connection pipe (4) is connected. The cooling facility circuit (61) has a gas end to which the second gas connection pipe (5) is connected.

The cooling facility circuit (61) includes a cooling facility expansion valve (63) and a cooling facility heat exchanger (64) arranged in this order from the liquid end toward the gas end. The cooling facility expansion valve (63) is a second utilization-side expansion valve. The cooling facility expansion valve (63) serves as an opening degree-changeable electronic expansion valve.

The cooling facility heat exchanger (64) is a second utilization-side heat exchanger. The cooling facility heat exchanger (64) is a fin-and-tube air heat exchanger. The cooling facility fan (62) is disposed near the cooling facility heat exchanger (64). The cooling facility fan (62) is configured to provide inside air. The cooling facility heat exchanger (64) causes the refrigerant flowing therethrough to exchange heat with the inside air provided by the cooling facility fan (62).

<Sensor>

The refrigeration apparatus (1) includes various sensors. The sensors include a high-pressure sensor (71), a high-pressure temperature sensor (72), a refrigerant temperature sensor (73), and an indoor temperature sensor (74). The high-pressure sensor (71) is configured to detect a pressure of the refrigerant discharged from the first compressor (21) (i.e., a pressure (HP) of the high-pressure refrigerant). The high-pressure temperature sensor (72) is configured to detect a temperature of the refrigerant discharged from the first compressor (21). The refrigerant temperature sensor (73) is configured to detect a temperature of the refrigerant at an outlet of the indoor heat exchanger (54) functioning as a radiator. The indoor temperature sensor (74) is configured to detect a temperature of indoor air in a target space (an indoor space) where the indoor unit (50) is installed.

The sensors also include an intermediate-pressure sensor (75), an intermediate-pressure refrigerant temperature sensor (76), a first suction pressure sensor (77), a first suction temperature sensor (78), a second suction pressure sensor (79), a second suction temperature sensor (80), an outside temperature sensor (81), a liquid refrigerant pressure sensor (81), and a liquid refrigerant temperature sensor (82). The intermediate-pressure sensor (75) is configured to detect a pressure of the refrigerant sucked in the first compressor (21) (i.e., a pressure (MP) of the intermediate-pressure refrigerant). The intermediate-pressure refrigerant temperature sensor (76) is configured to detect a temperature of the refrigerant sucked in the first compressor (21) (i.e., a temperature (Ts1) of the intermediate-pressure refrigerant). The first suction pressure sensor (77) is configured to detect a pressure (LP1) of the refrigerant sucked in the second compressor (22). The first suction temperature sensor (78) is configured to detect a temperature (Ts2) of the refrigerant sucked in the second compressor (22). The second suction pressure sensor (79) is configured to detect a pressure (LP2) of the refrigerant sucked in the third compressor (23). The third suction temperature sensor (80) is configured to detect a temperature (Ts3) of the refrigerant sucked in the third compressor (23). The outside temperature sensor (81) is configured to detect a temperature (Ta) of the outdoor air. The liquid refrigerant pressure sensor (82) is configured to detect a pressure of the liquid refrigerant flowing out of the gas-liquid separator (15), that is, a substantial pressure of the refrigerant in the gas-liquid separator (15). The liquid refrigerant temperature sensor (83) is configured to detect a temperature of the liquid refrigerant flowing out of the gas-liquid separator (15), that is, a substantial temperature of the refrigerant in the gas-liquid separator (15).

In the refrigeration apparatus (1), examples of physical quantities to be detected by other sensors (not illustrated) may include, but not limited to, a temperature of the high-pressure refrigerant, a temperature of the refrigerant in the outdoor heat exchanger (13), a temperature of the refrigerant in the cooling facility heat exchanger (64), and a temperature of the inside air.

<Controller>

Figure 2:
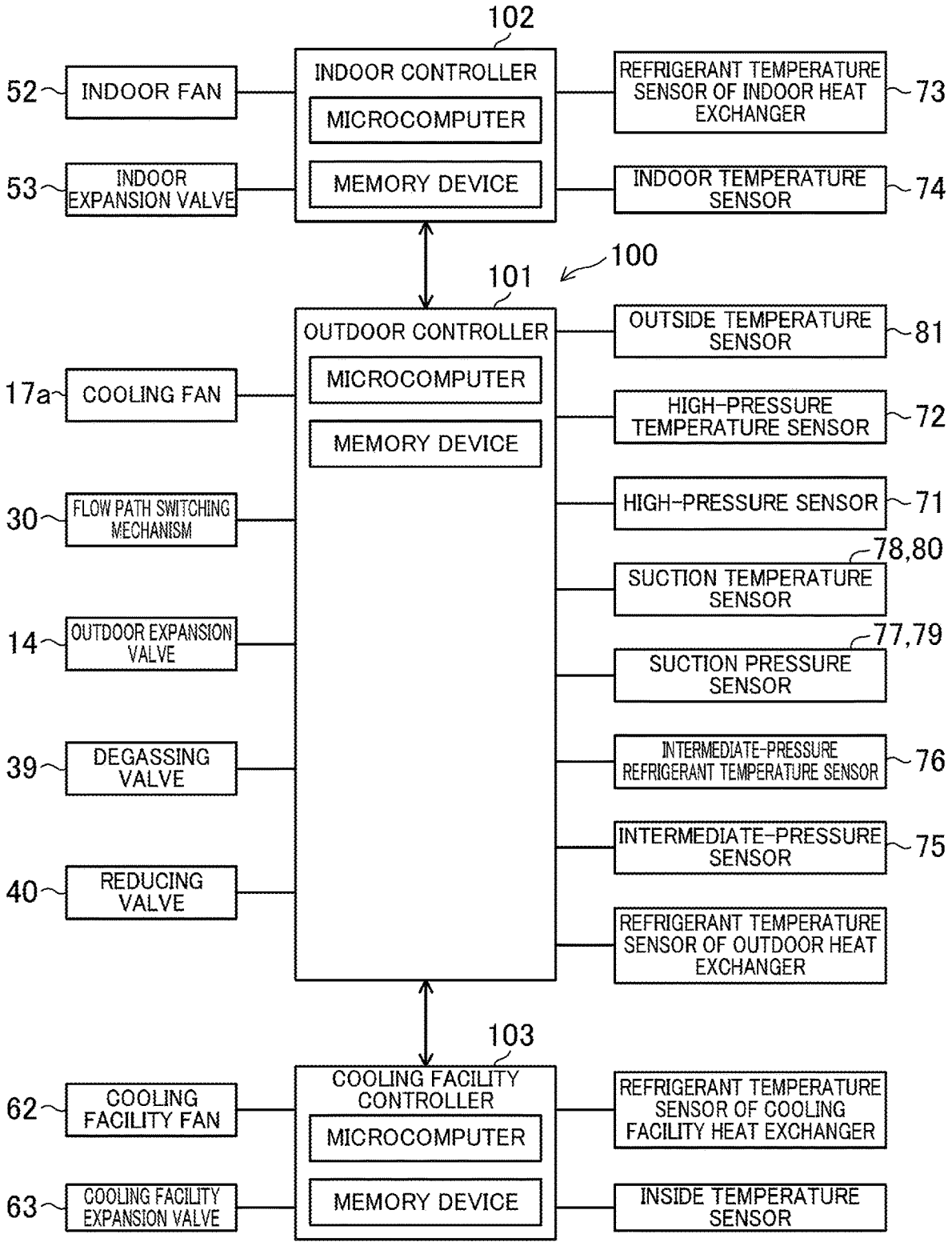
FIG. 2 is a block diagram of a relationship among a controller, various sensors, and constituent components of a refrigerant circuit.

The controller (100) is an example of a control unit. The controller (100) includes a microcomputer mounted on a control board, and a memory device (specifically, a semiconductor memory) storing software for operating the microcomputer. The controller (100) is configured to control the respective components of the refrigeration apparatus (1), based on an operation command and a detection signal from a sensor. The controller (100) controls the respective components, thereby changing an operation of the refrigeration apparatus (1). As illustrated in FIG. 2, the controller (100) is constituted of an outdoor controller (101) in the outdoor unit (10), an indoor controller (102) in the indoor unit (50), and a cooling facility controller (103) in the cooling facility unit (60). The outdoor controller (101) and the indoor controller (102) are capable of communicating with each other. The outdoor controller (101) and the cooling facility controller (103) are capable of communicating with each other. The controller (100) is connected via communication lines to various sensors including a temperature sensor configured to detect a temperature of the high-pressure refrigerant in the refrigerant circuit (6). The controller (100) is also connected via communication lines to the constituent components, such as the first compressor (21), the second compressor (22), and the third compressor (23), of the refrigerant circuit (6).

The controller (100) is configured to control an action of the refrigerant circuit (6). Specifically, when a stop condition of the indoor unit (50) is satisfied, the indoor controller (102) sends a thermo-off request. When a stop condition of the cooling facility unit (60) is satisfied, the cooling facility controller (103) sends a thermo-off request. In the following, a description will be given of the case where the indoor controller (102) sends a thermo-off request, as an example. When the outdoor controller (101) receives the thermo-off request from the indoor controller (102), then the outdoor controller (101) performs a pump-down action (which is an example of a first action) of recovering (at least a part of) the refrigerant from the indoor unit (50) and returning the refrigerant thus recovered to the outdoor unit (10). When a pump-down prohibition condition (which is an example of a first condition) indicating that the pressure at the heat source-side unit (10) is equal to or more than a critical pressure of the refrigerant is satisfied, the outdoor controller (101) performs a pump-down prohibition action (which is an example of a second action) of prohibiting the pump-down action and stopping the compression unit (20) without returning the refrigerant to the outdoor unit (10). Specifically, when the pump-down prohibition condition (the first condition) indicating that the internal pressure of the gas-liquid separator (15) of the heat source-side unit (10) is equal to or more than the critical pressure of the refrigerant is satisfied, the outdoor controller (101) performs the pump-down prohibition action (the second action) of prohibiting the pump-down action and stopping the compression unit (20) without returning the refrigerant to the outdoor unit (10).

The outdoor controller (101) determines that the pump-down prohibition condition is satisfied, when the outside temperature (Ta) detected by the outside temperature sensor (81) is higher than a predetermined temperature. The outdoor controller (101) also determines that the pump-down prohibition condition is satisfied, when the high pressure (HP) at the refrigerant circuit (6) has a value more than a predetermined value. This predetermined value is obtained by adding, in a case where the internal pressure of the gas-liquid separator (15) is equal to the critical pressure of the refrigerant, a difference in pressure between the high-pressure sensor (71) and the liquid refrigerant pressure sensor (82) (i.e., a pressure value corresponding to a pressure loss of the refrigerant) to a value of the critical pressure. This is because the high pressure (HP) detected by the high-pressure sensor (71) is higher by the pressure loss than the internal pressure of the gas-liquid separator (15).

In starting to perform the pump-down action, the outdoor controller (101) sends a first instruction to the indoor controller (102) such that the indoor controller (102) closes the indoor expansion valve (53). When the indoor controller (102) receives the first instruction, then the indoor controller (102) closes the indoor expansion valve (53). In the pump-down operation, therefore, the indoor expansion valve (53) is closed, and the refrigerant in the indoor heat exchanger (54) and first gas connection pipe (3) located downstream of the indoor expansion valve (53) is thus returned to the outdoor unit (10).

In performing the pump-down prohibition action, the outdoor controller (101) sends a second instruction to the indoor controller (102) such that the indoor controller (102) opens the indoor expansion valve (53) or maintains the indoor expansion valve (53) at an open state. When the indoor controller (102) receives the second instruction, then the indoor controller (102) opens the indoor expansion valve (53). In the pump-down prohibition action, therefore, the compression unit (20) stops with the indoor expansion valve (53) opened.

In performing the pump-down action, the outdoor controller (101) adjusts the opening degree of the outdoor expansion valve (14) such that the pressure of the refrigerant stored in the gas-liquid separator (15) becomes lower than the critical pressure. In other words, when the pressure of the refrigerant in the gas-liquid separator (15) is close to the critical pressure, the outdoor controller (101) increases the opening degree of the outdoor expansion valve (14) to reduce the pressure of the refrigerant flowing into the gas-liquid separator (15).

At startup of the compression unit (20) after the pump-down prohibition action, the outdoor controller (101) performs a liquid compression avoidance action (which is an example of a third operation) of stopping the lower-stage compression element (22, 23) and operating the higher-stage compression element (21). In the liquid compression avoidance action, the refrigerant in the indoor unit (50) flows into the outdoor unit. In the outdoor unit, since only the higher-stage compression element (21) operates, the refrigerant flows into the intermediate heat exchanger (17) via the third bypass passage (23*c*). At this time, since the cooling fan (17*a*) rotates, the intermediate heat exchanger evaporates the liquid refrigerant by causing the refrigerant to exchange heat with outdoor air. In other words, the intermediate heat exchanger (17) does not function as a cooler for cooling the refrigerant, but functions as an evaporator for heating and evaporating the refrigerant. The refrigerant, which has been evaporated by the intermediate heat exchanger (17), is sucked into and compressed by the higher-stage compression element (21). The refrigerant then flows into and is stored in each of the outdoor heat exchanger (13) and the gas-liquid separator (15). In a case where the cooling facility unit (60) sends a thermo-off request, the outdoor controller (101) and the cooling facility controller (103) respectively control the outdoor unit (10) and the cooling facility unit (60) in a manner similar to that described above.

Operations and Actions

Next, a specific description will be given of operations to be carried out by the refrigeration apparatus (1) and actions to be performed by the refrigeration apparatus (1). The operations of the refrigeration apparatus (1) include a cooling-facility operation, a cooling operation, a cooling and cooling-facility operation, a heating operation, a heating and cooling-facility operation, a heating and cooling-facility heat recovery operation, a heating and cooling-facility waste heat operation, and a defrosting operation. The operations of the refrigeration apparatus (1) also include the pump-down action (the first action) and the pump-down prohibition action (the second action) to be performed for temporarily stopping the indoor unit (50) as the utilization-side unit, that is, to be performed in a thermo-off state, and the liquid compression avoidance action (the third operation) to be performed after the pump-down prohibition action.

During the cooling-facility operation, the cooling facility unit (60) operates, while the indoor unit (50) stops. During the cooling operation, the cooling facility unit (60) stops, while the indoor unit (50) cools the indoor air. During the cooling and cooling-facility operation, the cooling facility unit (60) operates, while the indoor unit (50) cools the indoor air. During the heating operation, the cooling facility unit (60) stops, while the indoor unit (50) heats the indoor air. During the heating and cooling-facility operation, the heating and cooling-facility heat recovery operation, and the heating and cooling-facility waste heat operation, the cooling facility unit (60) operates, while the indoor unit (50) heats the indoor air. During the defrosting operation, the cooling facility unit (60) operates, while frost on a surface of the outdoor heat exchanger (13) is melted.

The heating and cooling-facility operation is carried out on a condition that a relatively large heating capacity is required for the indoor unit (50). The heating and cooling-facility waste heat operation is carried out on a condition that a relatively small heating capacity is required for the indoor unit (50). The heating and cooling-facility heat recovery operation is carried out on a condition that the heating capacity required for the indoor unit (50) falls within a range between a heating capacity required in the heating operation and a cooling capacity required in the cooling-facility operation (i.e., on a condition that the balance between the cooling capacity required in the cooling-facility operation and the heating capacity required in the heating operation is achieved).

<Cooling-Facility Operation>

Figure 3:
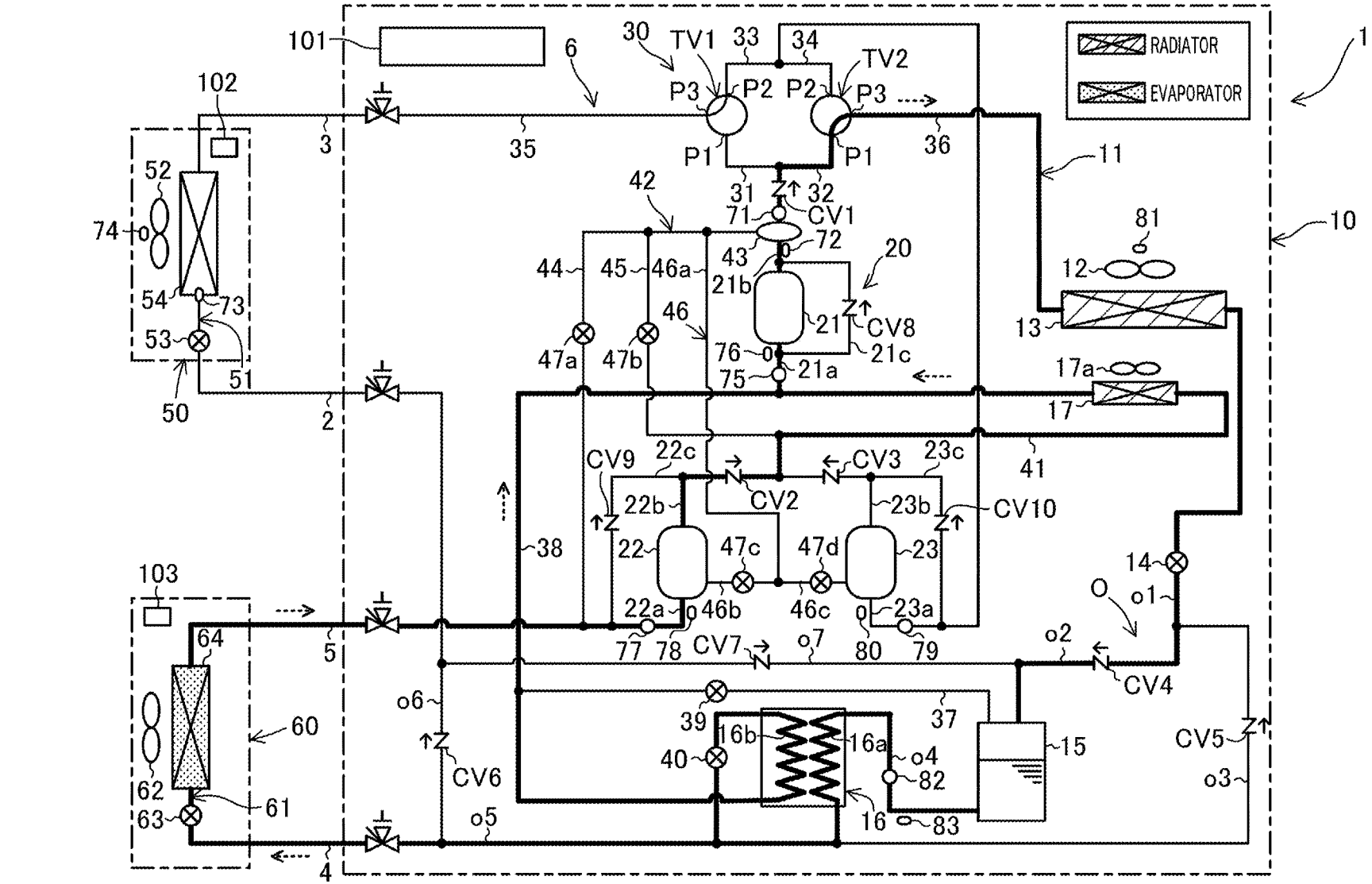
FIG. 3 is a diagram (equivalent to FIG. 1) of a flow of a refrigerant during a cooling-facility operation.

During the cooling-facility operation illustrated in FIG. 3, the first three-way valve (TV1) is in the second state, while the second three-way valve (TV2) is in the first state. The outdoor expansion valve (14) is opened at a predetermined opening degree. The opening degree of the cooling facility expansion valve (63) is adjusted by superheating control. The indoor expansion valve (53) is fully closed. The opening degree of the reducing valve (40) is appropriately adjusted. The outdoor fan (12), the cooling fan (17*a*), and the cooling facility fan (62) operate, while the indoor fan (52) stops. The first compressor (21) and the second compressor (22) operate, while the third compressor (23) stops. During the cooling-facility operation, a refrigeration cycle is achieved, in which the compression unit (20) compresses the refrigerant, the outdoor heat exchanger (13) causes the refrigerant to dissipate heat, and the cooling facility heat exchanger (64) evaporates the refrigerant.

As illustrated in FIG. 3, the second compressor (22) compresses the refrigerant, the intermediate heat exchanger (17) cools the refrigerant, and the first compressor (21) sucks in the refrigerant. After the first compressor (21) compresses the refrigerant, the outdoor heat exchanger (13) causes the refrigerant to dissipate heat. The refrigerant then flows through the gas-liquid separator (15). Thereafter, the cooling heat exchanger (16) cools the refrigerant. After the cooling heat exchanger (16) cools the refrigerant, the cooling facility expansion valve (63) decompresses the refrigerant, and the cooling facility heat exchanger (64) evaporates the refrigerant. The inside air is thus cooled. After the cooling heat exchanger (64) evaporates the refrigerant, the second compressor (22) sucks in the refrigerant to compress the refrigerant again.

<Cooling Operation>

Figure 4:
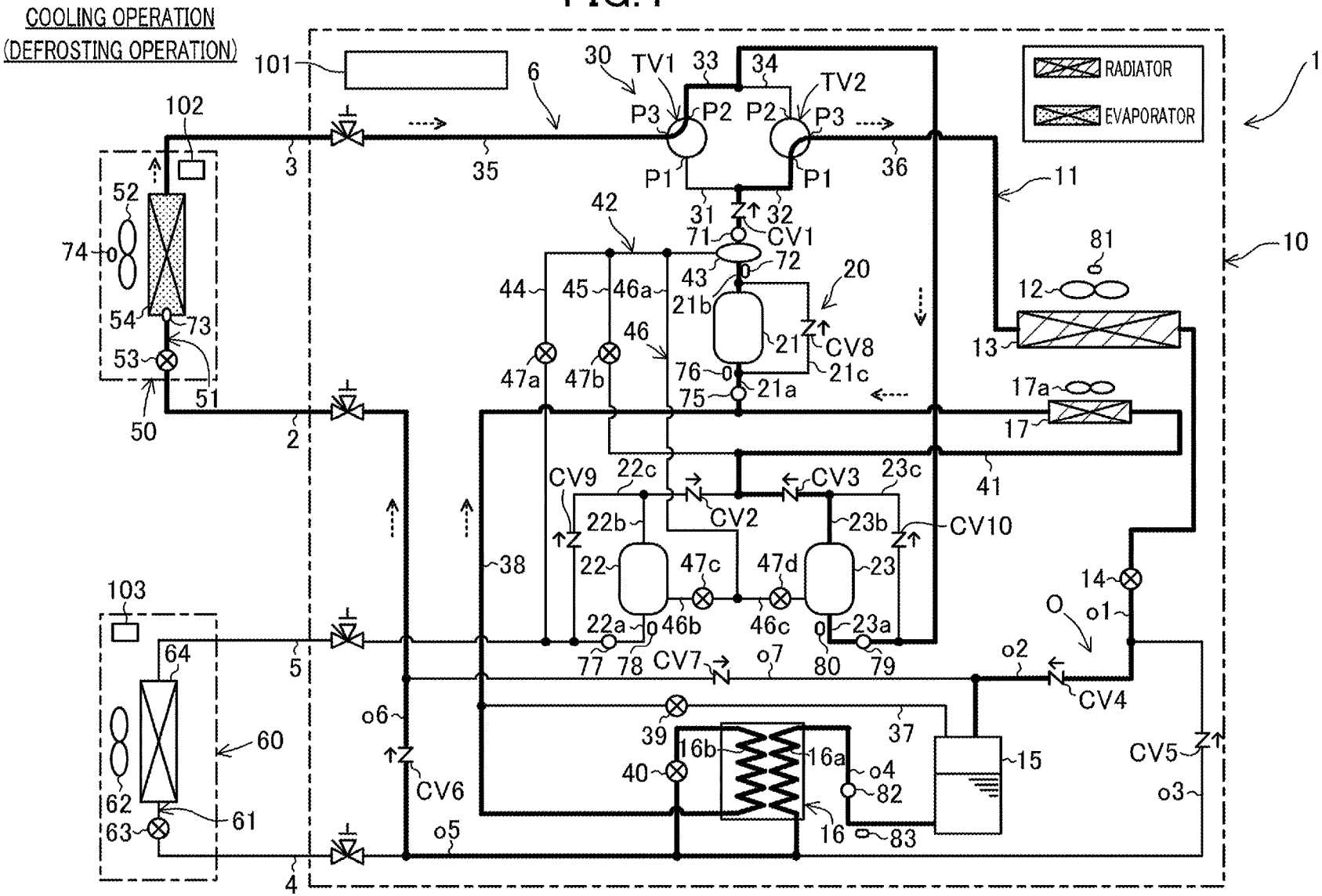
FIG. 4 is a diagram (equivalent to FIG. 1) of a flow of the refrigerant during a cooling operation.

During the cooling operation illustrated in FIG. 4, the first three-way valve (TV1) is in the second state, while the second three-way valve (TV2) is in the first state. The outdoor expansion valve (14) is opened at a predetermined opening degree. The cooling facility expansion valve (63) is fully closed. The opening degree of the indoor expansion valve (53) is adjusted by superheating control. The opening degree of the reducing valve (40) is appropriately adjusted. The outdoor fan (12), the cooling fan (17*a*), and the indoor fan (52) operate, while the cooling facility fan (62) stops. The first compressor (21) and the third compressor (23) operate, while the second compressor (22) stops. During the cooling operation, a refrigeration cycle is achieved, in which the compression unit (20) compresses the refrigerant, the outdoor heat exchanger (13) causes the refrigerant to dissipate heat, and the indoor heat exchanger (54) evaporates the refrigerant.

As illustrated in FIG. 4, the third compressor (23) compresses the refrigerant, the intermediate heat exchanger (17) cools the refrigerant, and the first compressor (21) sucks in the refrigerant. After the first compressor (21) compresses the refrigerant, the outdoor heat exchanger (13) causes the refrigerant to dissipate heat. The refrigerant then flows through the gas-liquid separator (15). Thereafter, the cooling heat exchanger (16) cools the refrigerant. After the cooling heat exchanger (16) cools the refrigerant, the indoor expansion valve (53) decompresses the refrigerant, and the indoor heat exchanger (54) evaporates the refrigerant. The indoor air is thus cooled. After the indoor heat exchanger (54) evaporates the refrigerant, the third compressor (23) sucks in the refrigerant to compress the refrigerant again.

<Cooling and Cooling-Facility Operation>

Figure 5:
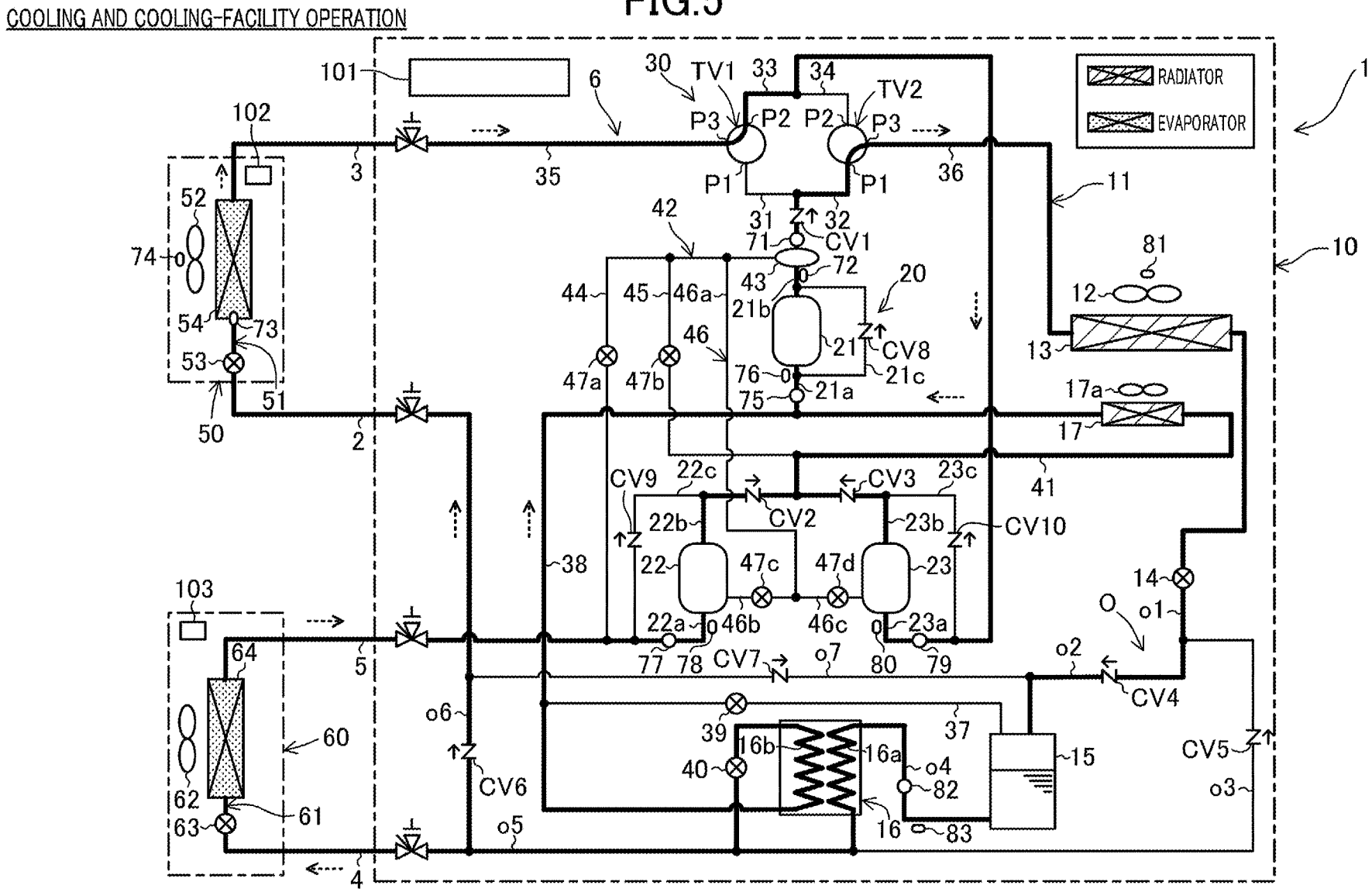
FIG. 5 is a diagram (equivalent to FIG. 1) of a flow of the refrigerant during a cooling and cooling-facility operation.

During the cooling and cooling-facility operation illustrated in FIG. 5, the first three-way valve (TV1) is in the second state, while the second three-way valve (TV2) is in the first state. The outdoor expansion valve (14) is opened at a predetermined opening degree. The opening degree of each of the cooling facility expansion valve (63) and the indoor expansion valve (53) is adjusted by superheating control. The opening degree of the reducing valve (40) is appropriately adjusted. The outdoor fan (12), the cooling fan (17*a*), the cooling facility fan (62), and the indoor fan (52) operate. The first compressor (21), the second compressor (22), and the third compressor (23) operate. During the cooling and cooling-facility operation, a refrigeration cycle is achieved, in which the compression unit (20) compresses the refrigerant, the outdoor heat exchanger (13) causes the refrigerant to dissipate heat, and each of the cooling facility heat exchanger (64) and the indoor heat exchanger (54) evaporates the refrigerant.

As illustrated in FIG. 5, each of the second compressor (22) and the third compressor (23) compresses the refrigerant, the intermediate heat exchanger (17) cools the refrigerant, and the first compressor (21) sucks in the refrigerant. After the first compressor (21) compresses the refrigerant, the outdoor heat exchanger (13) causes the refrigerant to dissipate heat. The refrigerant then flows through the gas-liquid separator (15). Thereafter, the cooling heat exchanger (16) cools the refrigerant. After the cooling heat exchanger (16) cools the refrigerant, the refrigerant is diverted into the cooling facility unit (60) and the indoor unit (50). The cooling facility expansion valve (63) decompresses the refrigerant, and the cooling facility heat exchanger (64) evaporates the refrigerant. After the cooling facility heat exchanger (64) evaporates the refrigerant, the second compressor (22) sucks in the refrigerant to compress the refrigerant again. The indoor expansion valve (53) decompresses the refrigerant, and the indoor heat exchanger (54) evaporates the refrigerant. After the indoor heat exchanger (54) evaporates the refrigerant, the third compressor (23) sucks in the refrigerant to compress the refrigerant again.

<Heating Operation>

Figure 6:
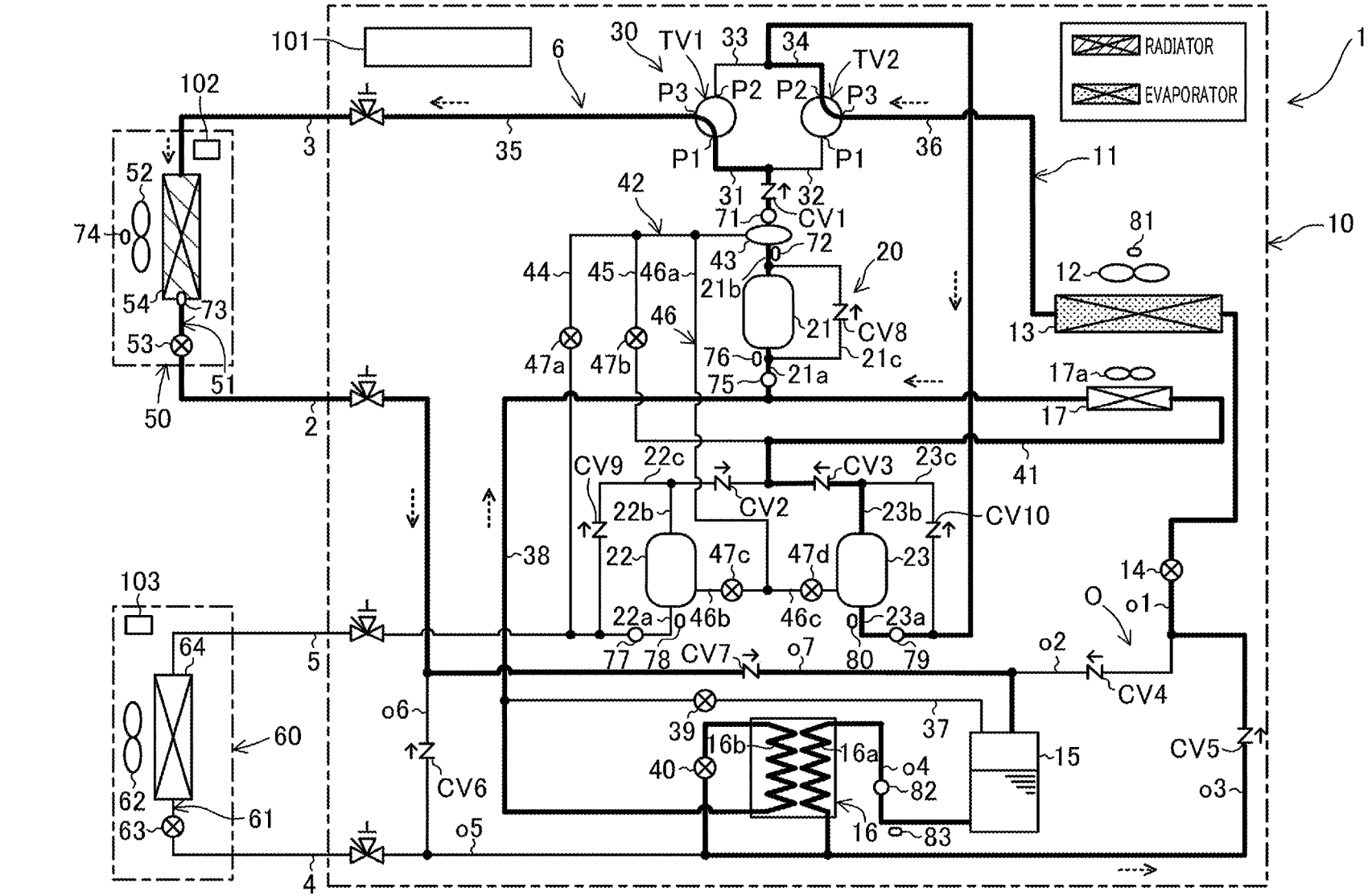
FIG. 6 is a diagram (equivalent to FIG. 1) of a flow of the refrigerant during a heating operation.

During the heating operation illustrated in FIG. 6, the first three-way valve (TV1) is in the first state, while the second three-way valve (TV2) is in the second state. The indoor expansion valve (53) is opened at a predetermined opening degree. The cooling facility expansion valve (63) is fully closed. The opening degree of the outdoor expansion valve (14) is adjusted by superheating control. The opening degree of the reducing valve (40) is appropriately adjusted. The outdoor fan (12) and the indoor fan (52) operate, while the cooling fan (17*a*) and the cooling facility fan (62) stop. The first compressor (21) and the third compressor (23) operate, while the second compressor (22) stops. During the heating operation, a refrigeration cycle is achieved, in which the compression unit (20) compresses the refrigerant, the indoor heat exchanger (54) causes the refrigerant to dissipate heat, and the outdoor heat exchanger (13) evaporates the refrigerant.

As illustrated in FIG. 6, after the third compressor (23) compresses the refrigerant, the refrigerant flows through the intermediate heat exchanger (17). The first compressor (21) then sucks in the refrigerant. After the first compressor (21) compresses the refrigerant, the indoor heat exchanger (54) causes the refrigerant to dissipate heat. The indoor air is thus heated. After the indoor heat exchanger (54) causes the refrigerant to dissipate heat, the refrigerant flows through the gas-liquid separator (15). The cooling heat exchanger (16) then cools the refrigerant. After the cooling heat exchanger (16) cools the refrigerant, the outdoor expansion valve (14) decompresses the refrigerant, and the outdoor heat exchanger (13) evaporates the refrigerant. After the outdoor heat exchanger (13) evaporates the refrigerant, the third compressor (23) sucks in the refrigerant to compress the refrigerant again.

<Heating and Cooling-Facility Operation>

Figure 7:
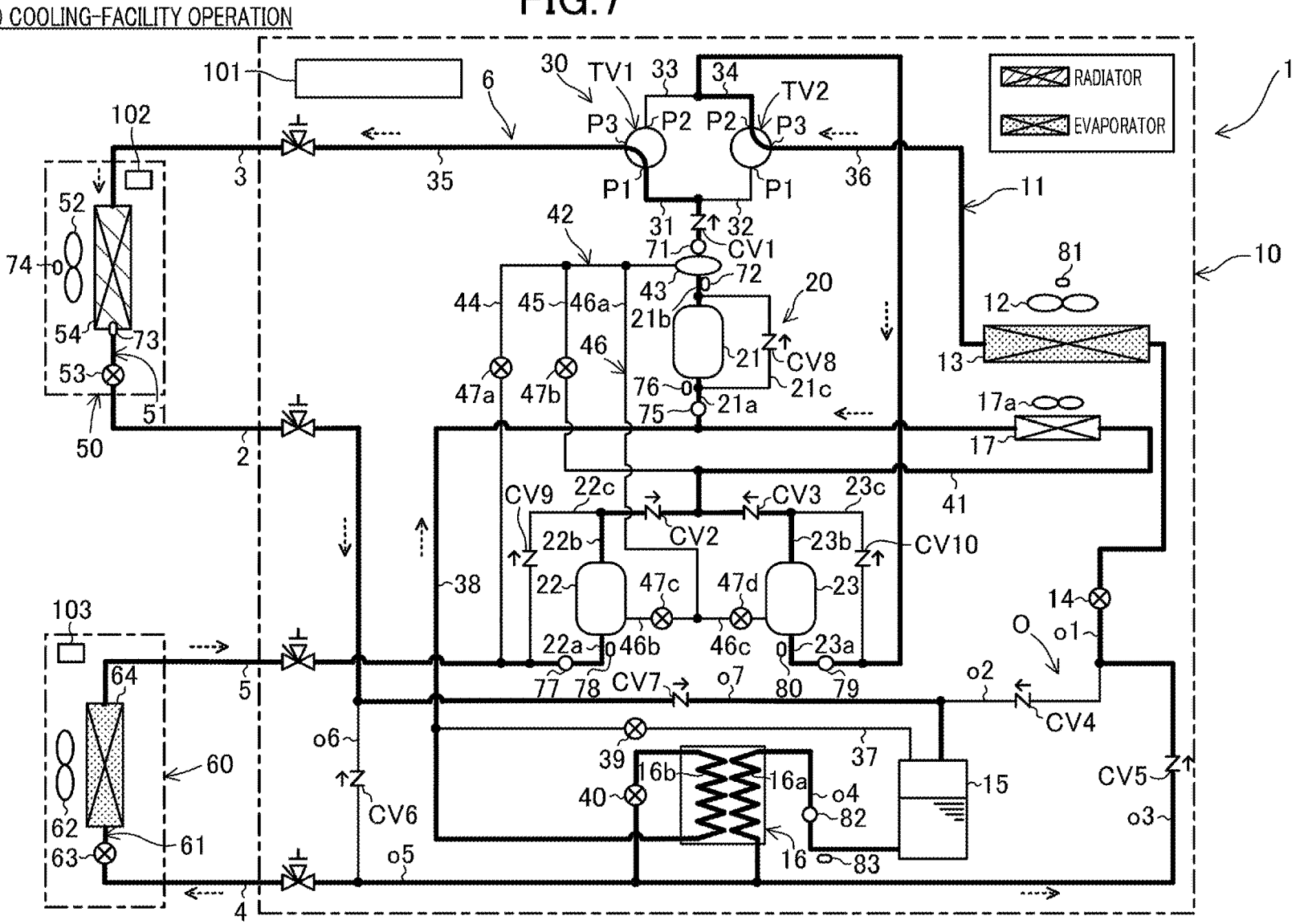
FIG. 7 is a diagram (equivalent to FIG. 1) of a flow of the refrigerant during a heating and cooling-facility operation.

During the heating and cooling-facility operation illustrated in FIG. 7, the first three-way valve (TV1) is in the first state, while the second three-way valve (TV2) is in the second state. The indoor expansion valve (53) is opened at a predetermined opening degree. The opening degree of each of the cooling facility expansion valve (63) and the outdoor expansion valve (14) is adjusted by superheating control. The opening degree of the reducing valve (40) is appropriately adjusted. The outdoor fan (12), the cooling facility fan (62), and the indoor fan (52) operate, while the cooling fan (17*a*) stops. The first compressor (21), the second compressor (22), and the third compressor (23) operate. During the heating and cooling-facility operation, a refrigeration cycle (a third refrigeration cycle) is achieved, in which the compression unit (20) compresses the refrigerant, the indoor heat exchanger (54) causes the refrigerant to dissipate heat, and each of the cooling facility heat exchanger (64) and the outdoor heat exchanger (13) evaporates the refrigerant.

As illustrated in FIG. 7, after each of the second compressor (22) and the third compressor (23) compresses the refrigerant, the refrigerant flows through the intermediate heat exchanger (17). The first compressor (21) then sucks in the refrigerant. After the first compressor (21) compresses the refrigerant, the indoor heat exchanger (54) causes the refrigerant to dissipate heat. The indoor air is thus heated. After the indoor heat exchanger (54) causes the refrigerant to dissipate heat, the refrigerant flows through the gas-liquid separator (15). The cooling heat exchanger (16) then cools the refrigerant. After the cooling heat exchanger (16) cools the refrigerant, the outdoor expansion valve (14) decompresses a part of the refrigerant, and the outdoor heat exchanger (13) evaporates the refrigerant. After the outdoor heat exchanger (13) evaporates the refrigerant, the third compressor (23) sucks in the refrigerant to compress the refrigerant again.

After the cooling heat exchanger (16) cools the refrigerant, the cooling facility expansion valve (63) decompresses the remaining refrigerant, and the cooling facility heat exchanger (64) evaporates the refrigerant. The inside air is thus cooled. After the cooling facility heat exchanger (64) evaporates the refrigerant, the second compressor (22) sucks in the refrigerant to compress the refrigerant again.

<Heating and Cooling-Facility Heat Recovery Operation>

Figure 8:
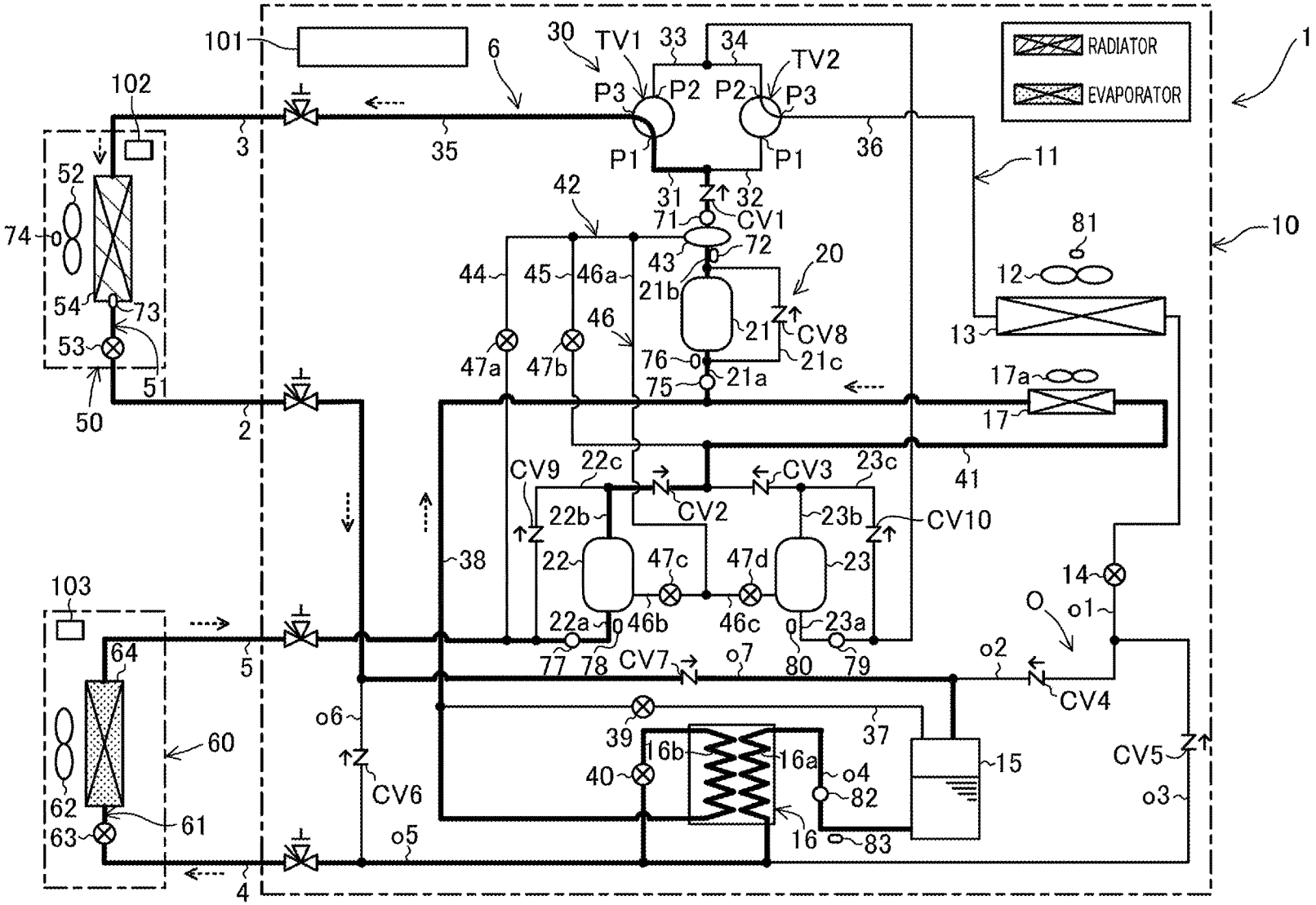
FIG. 8 is a diagram (equivalent to FIG. 1) of a flow of the refrigerant during a heating and cooling-facility heat recovery operation.

During the heating and cooling-facility heat recovery operation illustrated in FIG. 8, the first three-way valve (TV1) is in the first state, while the second three-way valve (TV2) is in the second state. The indoor expansion valve (53) is opened at a predetermined opening degree. The outdoor expansion valve (14) is fully closed. The opening degree of the cooling facility expansion valve (63) is adjusted by superheating control. The opening degree of the reducing valve (40) is appropriately adjusted. The indoor fan (52) and the cooling facility fan (62) operate, while the cooling fan (17*a*) and the outdoor fan (12) stop. The first compressor (21) and the second compressor (22) operate, while the third compressor (23) stops. During the heating and cooling-facility heat recovery operation, a refrigeration cycle (a first refrigeration cycle) is achieved, in which the compression unit (20) compresses the refrigerant, the indoor heat exchanger (54) causes the refrigerant to dissipate heat, the cooling facility heat exchanger (64) evaporates the refrigerant, and the outdoor heat exchanger (13) substantially stops.

As illustrated in FIG. 8, after the second compressor (22) compresses the refrigerant, the refrigerant flows through the intermediate heat exchanger (17). The first compressor (21) then sucks in the refrigerant. After the first compressor (21) compresses the refrigerant, the indoor heat exchanger (54) causes the refrigerant to dissipate heat. The indoor air is thus heated. After the indoor heat exchanger (54) causes the refrigerant to dissipate heat, the refrigerant flows through the gas-liquid separator (15). The cooling heat exchanger (16) then cools the refrigerant. After the cooling heat exchanger (16) cools the refrigerant, the cooling facility expansion valve (63) decompresses the refrigerant, and the cooling facility heat exchanger (64) evaporates the refrigerant. After the cooling facility heat exchanger (64) evaporates the refrigerant, the second compressor (22) sucks in the refrigerant to compress the refrigerant again.

<Heating and Cooling-Facility Waste Heat Operation>

Figure 9:
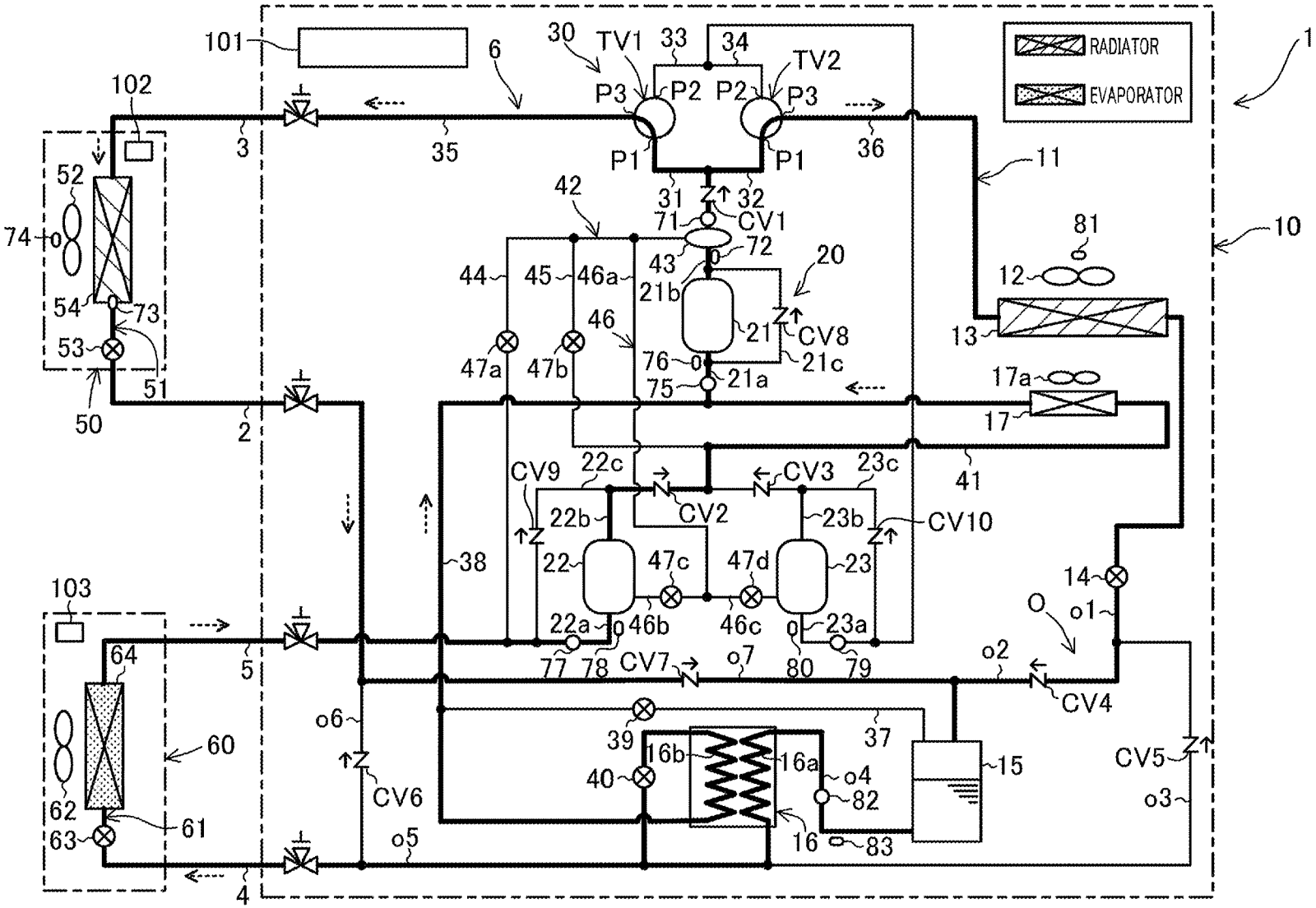
FIG. 9 is a diagram (equivalent to FIG. 1) of a flow of the refrigerant during a heating and cooling-facility waste heat operation.

During the heating and cooling-facility waste heat operation illustrated in FIG. 9, the first three-way valve (TV1) is in the first state, while the second three-way valve (TV2) is in the first state. Each of the indoor expansion valve (53) and the outdoor expansion valve (14) is opened at a predetermined opening degree. The opening degree of the cooling facility expansion valve (63) is adjusted by superheating control. The opening degree of the reducing valve (40) is appropriately adjusted. The outdoor fan (12), the cooling facility fan (62), and the indoor fan (52) operate, while the cooling fan (17*a*) stops. The first compressor (21) and the second compressor (22) operate, while the third compressor (23) stops. During the heating and cooling-facility waste heat operation, a refrigeration cycle (a second refrigeration cycle) is achieved, in which the compression unit (20) compresses the refrigerant, each of the indoor heat exchanger (54) and the outdoor heat exchanger (13) causes the refrigerant to radiate heat, and the cooling facility heat exchanger (64) evaporates the refrigerant.

As illustrated in FIG. 9, after the second compressor (22) compresses the refrigerant, the refrigerant flows through the intermediate heat exchanger (17). The first compressor (21) then sucks in the refrigerant. After the first compressor (21)

compresses the refrigerant, the outdoor heat exchanger (13) causes a part of the refrigerant to dissipate heat. After the first compressor (21) compresses the refrigerant, the indoor heat exchanger (54) causes the remaining refrigerant to dissipate heat. The indoor air is thus heated. After the outdoor heat exchanger (13) causes the refrigerant to dissipate heat and the indoor heat exchanger (54) causes the refrigerant to dissipate heat, both the refrigerants flow into the gas-liquid separator (15) in a merged state. The cooling heat exchanger (16) then cools the refrigerant. After the cooling heat exchanger (16) cools the refrigerant, the cooling facility expansion valve (63) decompresses the refrigerant, and the cooling facility heat exchanger (64) evaporates the refrigerant. The inside air is thus cooled. After the cooling facility heat exchanger (64) evaporates the refrigerant, the second compressor (22) sucks in the refrigerant to compress the refrigerant again.

<Defrosting Operation>

During the defrosting operation, the respective components operate in the same manners as those during the cooling operation illustrated in FIG. 4. During the defrosting operation, each of the third compressor (23) and the first compressor (21) compresses the refrigerant, and the outdoor heat exchanger (13) causes the refrigerant to dissipate heat. The heat inside the outdoor heat exchanger (13) thus melts frost on the surface of the outdoor heat exchanger (13). After the defrosting in the outdoor heat exchanger (13), the indoor heat exchanger (54) evaporates the refrigerant, and then the third compressor (23) sucks in the refrigerant to compress the refrigerant again.

<Thermo-Off Control and Thermo-On Control>

Figure 10:
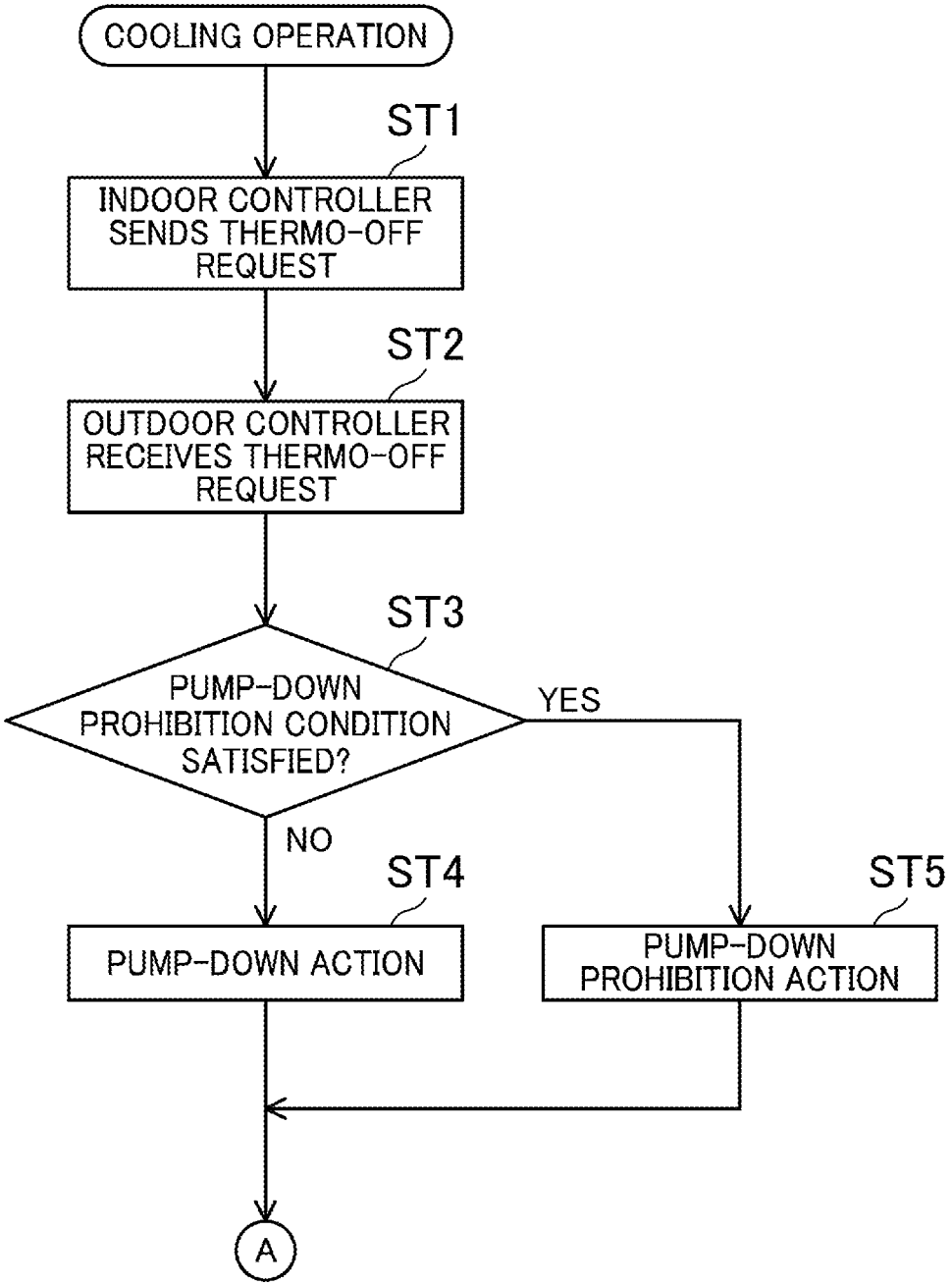
FIG. 10 is a flowchart of control by a refrigerant circuit in a thermo-off state.

With reference to a flowchart of FIG. 10, a description will be given of actions of the indoor unit (50) and cooling facility unit (60) in a thermo-off state. With reference to a flowchart of FIG. 11, a description will be given of actions of the indoor unit (50) and cooling facility unit (60) in a thermo-on state. These actions are performed in the cooling-facility operation illustrated in FIG. 3, the cooling operation illustrated in FIG. 4, and the cooling and cooling-facility operation illustrated in FIG. 5. In FIG. 10, the term "cooling operation" refers to these operations.

<Thermo-Off Control During Cooling Operation>

When the stop condition of the indoor unit (50) is satisfied in the cooling operation illustrated in FIG. 4 and the cooling and cooling-facility operation illustrated in FIG. 5, in step ST1 illustrated in FIG. 10, the indoor controller (102) sends a thermo-off request to the outdoor controller (101).

In step ST2, the outdoor controller (101) receives the thermo-off request from the indoor controller (102). In step ST3, the outdoor controller (101) determines whether the pump-down prohibition condition indicating that the internal pressure of the outdoor unit (10) (specifically, the gas-liquid separator (15)) is equal to or more than the critical pressure of the refrigerant is satisfied. As a result of the determination in step ST3, when the pump-down prohibition condition is not satisfied, the processing proceeds to step ST4 in which the outdoor controller (101) performs the pump-down action. On the other hand, when the pump-down prohibition condition is satisfied, the processing proceeds to step ST5 in which the outdoor controller (101) performs the pump-down prohibition action.

In step ST4, the outdoor controller (101) performs the pump-down action. Specifically, the outdoor controller (101) sends a first instruction to the indoor controller (102) such that the indoor controller (102) closes the indoor expansion valve (53). When the indoor controller (102) receives the first instruction, then the indoor controller (102) closes the indoor expansion valve (53). At this time, the outdoor controller (101) continuously operates the compression unit (20). The refrigerant in the indoor heat exchanger (54) and first gas connection pipe (3) located downstream of the indoor expansion valve (53) is thus returned to the outdoor unit (10). By the pump-down action, the refrigerant downstream of the indoor expansion valve (53) is sucked into the compression unit (20). The refrigerant is then discharged from the compression unit (20) and is stored in each of the outdoor heat exchanger (13) and the gas-liquid separator (15). In performing the pump-down action, the outdoor controller (101) adjusts the opening degree of the outdoor expansion valve (14) such that the pressure of the refrigerant stored in the gas-liquid separator (15) becomes lower than the critical pressure. Therefore, when the pressure of the refrigerant in the gas-liquid separator (15) is close to the critical pressure, the outdoor controller (101) increases the opening degree of the outdoor expansion valve (14). As a result, the outdoor controller (101) reduces the pressure of the refrigerant flowing into the gas-liquid separator (15). This configuration thus suppresses a pressure rise in the gas-liquid separator (15). Since the indoor expansion valve (53) is closed during the pump-down action, the refrigerant in the outdoor unit (10) hardly flows into the indoor unit (50). When a predetermined condition is satisfied in the pump-down action, the compression unit (20) stops. The predetermined condition includes a condition to be determined that the recovery of the refrigerant from the indoor unit (50) is almost completed, for example, a condition that the suction pressure of the compression unit (20) has a value equal to or less than the predetermined value.

As a result of the determination in step ST3, when the pump-down prohibition condition is satisfied, the processing proceeds to step ST5 in which the outdoor controller (101) performs the pump-down prohibition action. Specifically, the outdoor controller (101) sends a second instruction to the indoor controller (102) such that the indoor controller (102) opens the indoor expansion valve (53) or maintains the indoor expansion valve (53) at the open state. When the indoor controller (102) receives the second instruction, then the indoor controller (102) opens the indoor expansion valve (53) or maintains the indoor expansion valve (53) at the open state. At this time, the outdoor controller (101) stops the compression unit (20). With this configuration, the refrigerant does not flow into the outdoor heat exchanger (13) and the gas-liquid separator (15). The pump-down prohibition condition indicates that the internal pressure of the gas-liquid separator (15) is equal to or more than the critical pressure of the refrigerant. By the pump-down prohibition action, the refrigerant does not flow into the outdoor heat exchanger (13) and the gas-liquid separator (15). This configuration therefore suppresses a further pressure rise at the outdoor heat exchanger (13) and the gas-liquid separator (15).

<Thermo-Off Control During Cooling-Facility Operation>

When the stop condition of the cooling facility unit (60) is satisfied in the cooling-facility operation illustrated in FIG. 3 and the cooling and cooling-facility operation illustrated in FIG. 5, in step ST1, the indoor controller (102) sends a thermo-off request to the outdoor controller (101).

In step ST2, the outdoor controller (101) receives the thermo-off request from the cooling facility controller (103). In step ST3, the outdoor controller (101) determines whether the pump-down prohibition condition indicating that the internal pressure of the outdoor unit (10) (specifically, the gas-liquid separator (15)) is equal to or more than the critical pressure of the refrigerant is satisfied. As a result of the determination in step ST3, when the pump-down prohibition condition is not satisfied, the processing proceeds to step ST4 in which the outdoor controller (101) performs the pump-down action. On the other hand, when the pump-down prohibition condition is satisfied, the processing proceeds to step ST5 in which the outdoor controller (101) performs the pump-down prohibition action.

In step ST4, the outdoor controller (101) performs the pump-down action. Specifically, the outdoor controller (101) sends a first instruction to the cooling facility controller (103) such that the cooling facility controller (103) closes the cooling facility expansion valve (63). When the cooling facility controller (103) receives the first instruction, then the cooling facility controller (103) closes the cooling facility expansion valve (63). At this time, the outdoor controller (101) continuously operates the compression unit (20). The refrigerant downstream of the cooling facility expansion valve (63) is thus returned to the outdoor unit (10). Other processing tasks are similar to those in the pump-down action for the indoor unit (50).

As a result of the determination in step ST3, when the pump-down prohibition condition is satisfied in the case where the outdoor controller (101) receives the thermo-off request from the cooling facility controller (103), the processing proceeds to step ST5 in which the outdoor controller (101) performs the pump-down prohibition action. Specifically, the outdoor controller (101) sends a second instruction to the cooling facility controller (103) such that the cooling facility controller (103) opens the cooling facility expansion valve (63) or maintains the cooling facility expansion valve (63) at the open state. When the cooling facility controller (103) receives the second instruction, then the cooling facility controller (103) opens the cooling facility expansion valve (63) or maintains the cooling facility expansion valve (63) at the open state. At this time, the outdoor controller (101) stops the compression unit (20). Also in this case, the refrigerant does not flow into the outdoor heat exchanger (13) and the gas-liquid separator (15). This configuration therefore suppresses a further pressure rise in the outdoor heat exchanger (13) and the gas-liquid separator (15).

Figure 11:
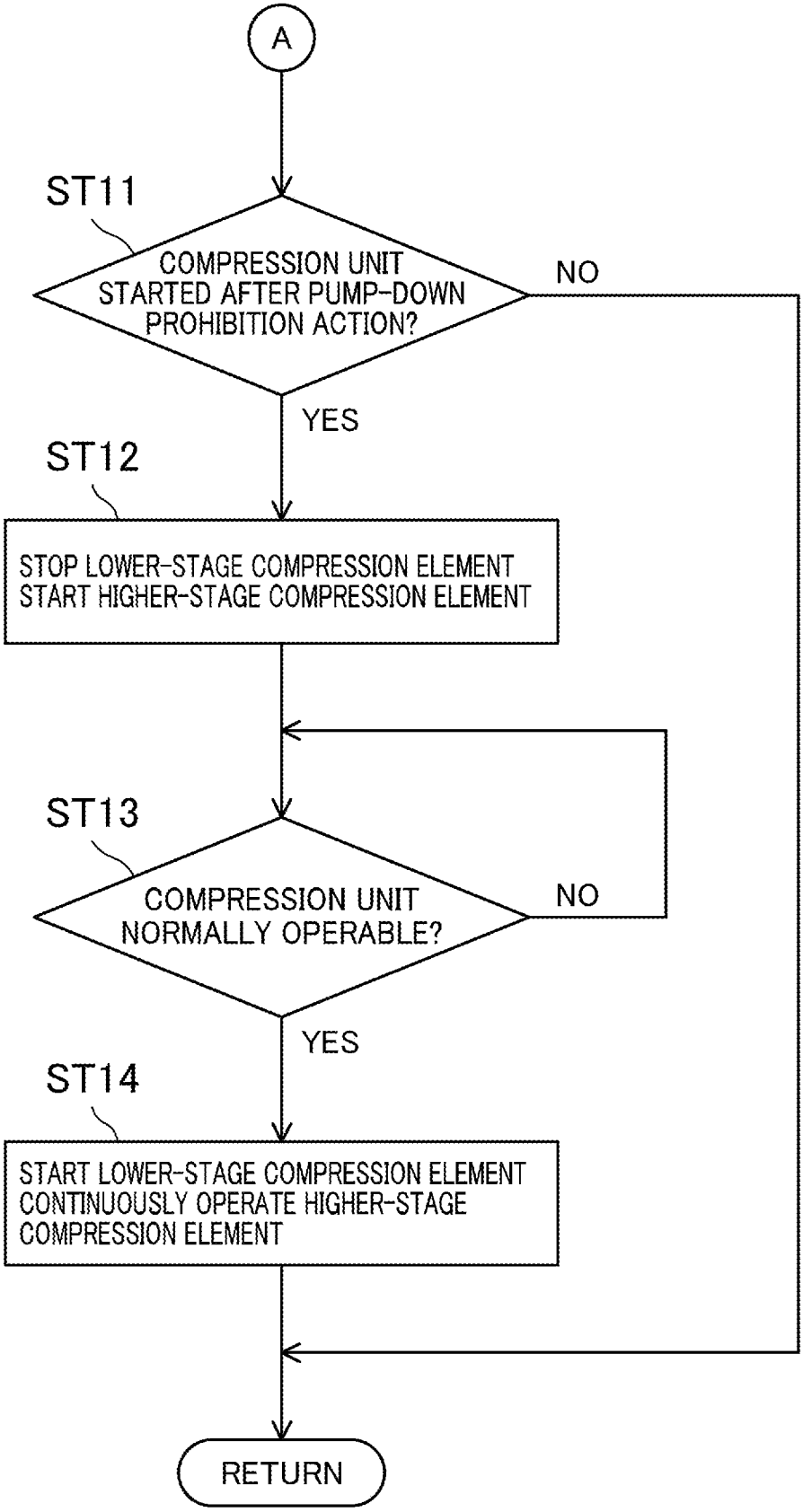
FIG. 11 is a flowchart of control in a thermo-on state.

With reference to the flowchart of FIG. 11, a description will be given of an action in the thermo-on state. In starting the action in accordance with the flowchart, in step ST11, the outdoor controller (101) determines whether the compression unit (20) is started after the pump-down prohibition action. When the compression unit (20) is not started after the pump-down prohibition action, the outdoor controller (101) performs normal startup control. When the compression unit (20) is started after the pump-down prohibition action, the processing proceeds to step ST12 in which the outdoor controller (101) performs the liquid compression avoidance action of stopping the lower-stage compression element (22, 23) and operating the higher-stage compression element (21).

In step ST12, the outdoor controller (101) performs the liquid compression avoidance action. Specifically, the outdoor controller (101) starts only the higher-stage compression element (21). The refrigerant in one of or each of the indoor unit (50) and the cooling facility unit (60) flows into the outdoor unit (10). In the outdoor unit (10), the refrigerant flows into the intermediate heat exchanger (17) via one of or each of the second bypass passage (22*c*) and the third bypass passage (23*c*). Since the cooling fan (17*a*) rotates, the intermediate heat exchanger (17) evaporates the refrigerant by causing the refrigerant to exchange heat with outdoor air. At this time, the intermediate heat exchanger (17) does not function as a cooler for cooling the refrigerant, but functions as an evaporator for heating and evaporating the refrigerant. After the intermediate heat exchanger (17) evaporates the refrigerant, the higher-stage compression element (21) sucks in the refrigerant and compresses the refrigerant. This configuration thus suppresses occurrence of liquid compression. The refrigerant is then discharged from the higher-stage compression element (21), and flows into the outdoor heat exchanger (13) and the gas-liquid separator (15) again. The refrigerant in the gas-liquid separator (15) flows out of the outdoor unit (10).

When the outdoor controller (101) continuously performs the liquid compression avoidance action, the liquid refrigerant on the suction side of the lower-stage compression element (22, 23) decreases. In step ST13, the outdoor controller (101) determines whether the compression unit (20) is normally operable, from the values detected by the respective sensors. In step ST13, for example, the outdoor controller (101) determines whether the degree of superheating of the refrigerant on the suction side of the lower-stage compression element (22, 23) has a value equal to or more than a predetermined value, from the values detected by the suction pressure sensor (77, 79) and suction temperature sensor (78, 80) for the lower-stage compression element (22, 23).

When the outdoor controller (101) determines in step ST13 that the degree of suction superheating of the refrigerant has a value equal to or more than the predetermined value, that is, the refrigerant is in a dry state, the processing proceeds to step ST14. In step ST14, the outdoor controller (101) continuously operates the higher-stage compression element (21), and starts the lower-stage compression element (22, 23) to perform a two-stage compression action. The thermo-on control after the pump-down prohibition operation thus ends.

Advantageous Effects of Embodiment

This embodiment provides a refrigeration apparatus (1) including a refrigerant circuit (6) including an outdoor unit (10) and an indoor unit (50) that are connected to each other, the refrigerant circuit (6) being configured to perform a refrigeration cycle in which a high pressure reaches or exceeds a critical pressure of the refrigerant. The outdoor unit (10) includes a gas-liquid separator (15) disposed downstream of an outdoor heat exchanger (13) functioning as a radiator in the refrigerant circuit (6).

According to this embodiment, an outdoor controller (101) configured to control an action of the refrigerant circuit (6) is capable of performing a pump-down action of recovering at least a part of the refrigerant from the indoor unit (50) and returning the refrigerant thus recovered to the outdoor unit (10) in a case where a stop condition of the indoor unit (50) is satisfied, and a pump-down prohibition action of prohibiting the pump-down action in a case where a pump-down prohibition condition indicating that a pressure at the gas-liquid separator (15) is equal to or more than the critical pressure of the refrigerant is satisfied.

In a known refrigeration apparatus that employs, for example, carbon dioxide as a refrigerant and performs a refrigeration cycle in which a high pressure at a refrigerant circuit reaches or exceeds a critical pressure of the refrigerant, the refrigerant in a gas-liquid separator may expand when outdoor air rises in temperature. Therefore, when a pump-down action is performed for returning the refrigerant to a heat source-side unit in stopping an action of an indoor unit, a pressure at the gas-liquid separator and a pressure at an outdoor heat exchanger abnormally increase in the heat source-side unit, so that these components may be damaged.

In view of this, in the refrigeration apparatus according to this embodiment, an indoor controller (102) sends a thermo-off request to the outdoor controller (101) when an air conditioning load is satisfactorily decreased in an air conditioning unit and a stop condition is satisfied. The outdoor controller (101), which has received the thermo-off request, performs the pump-down action of recovering (at least a part of) the refrigerant from the indoor unit (50) and returning the refrigerant thus recovered to the outdoor unit (10). In this case, when a pump-down prohibition condition is satisfied, the outdoor controller (101) determines that the pressure at the gas-liquid separator (15) is equal to or more than the critical pressure of the refrigerant, and performs the pump-down prohibition action of prohibiting the pump-down action. The outdoor controller (101) performs the pump-down prohibition action to stop the action of the indoor unit (50) without returning the refrigerant to the outdoor unit (10). Examples of the pump-down prohibition condition may include, but not limited to, in addition to the case where the detected pressure at the gas-liquid separator (15) is equal to or more than the critical pressure of the refrigerant, a case where the detected outside temperature is higher than a predetermined temperature so that an internal pressure of the gas-liquid separator (15) reaches or exceeds the critical pressure and a case where a detected value of the high pressure at the refrigerant circuit (6) is more than a predetermined value so that the internal pressure of the gas-liquid separator (15) reaches or exceeds the critical pressure.

According to this embodiment, the outdoor controller (101) does not perform the pump-down action, but stops the action of the indoor unit (50) when the pump-down prohibition condition is satisfied. This configuration therefore suppresses an abnormal pressure rise in the gas-liquid separator and the outdoor heat exchanger. This configuration thus suppresses damage to components such as the gas-liquid separator and the outdoor heat exchanger.

According to this embodiment, an indoor expansion valve (53) is closed during the pump-down action. According to this configuration, the pump-down action of returning the refrigerant to the outdoor unit (10) is performed with the indoor expansion valve (53) closed. The outdoor controller (101) thus performs the pump-down action to return, to the outdoor unit (10), the refrigerant in the indoor heat exchanger (54) and a connection pipe located downstream of the indoor expansion valve (53).

According to this embodiment, the indoor expansion valve (53) is open during the pump-down prohibition action. The outdoor controller (101) thus performs the pump-down prohibition action to stop the action of the indoor unit (50) without returning the refrigerant to the outdoor unit (10), with the indoor expansion valve (53) opened.

According to this embodiment, in performing the pump-down action, the outdoor controller (101) adjusts the opening degree of the outdoor expansion valve (14) such that the pressure of the refrigerant stored in the gas-liquid separator (15) becomes lower than the critical pressure. This configuration thus suppresses an excessive pressure rise in the gas-liquid separator (15) in the pump-down action and encourages the refrigerant to flow into the gas-liquid separator (15).

According to this embodiment, the outdoor controller (101) performs a liquid compression avoidance action of stopping the third compressor (23) constituting the lower-stage compression element, operating the first compressor (21) constituting the higher-stage compression element, and causing an intermediate heat exchanger (17) to function as an evaporator at startup of the compression unit (20) after the outdoor controller (101) performs the pump-down prohibition action to prohibit the pump-down action.

In a state in which the outdoor controller (101) prohibits the pump-down action and the indoor unit (50) stops, the refrigerant (the liquid refrigerant) is sometimes stored downstream of the indoor expansion valve (53). According to this embodiment, in starting the compression unit (20) in this state, the outdoor controller (101) stops the third compressor (23) constituting the lower-stage compression element and operates the first compressor (21) constituting the higher-stage compression element. The liquid refrigerant to be returned to the outdoor unit thus flows through the bypass passage (23*c*) so as to detour around the third compressor (23). The liquid refrigerant is then evaporated by the intermediate heat exchanger (17) and is sucked into the first compressor (21). This configuration thus suppresses occurrence of liquid compression in the compression unit (20).

<<Other Embodiments>>

The foregoing embodiment may have the following configurations.

The refrigeration apparatus (1) may include one heat source-side unit and one utilization-side unit. The utilization-side unit may be an indoor unit (50) for conditioning indoor air or may be a cooling facility unit (60) for cooling inside air.

The refrigeration apparatus (1) may include one outdoor unit (10) and a plurality of indoor units (50) connected in parallel to the outdoor unit (10). The refrigeration apparatus (1) may alternatively include one outdoor unit (10) and a plurality of cooling facility units (60) connected in parallel to the outdoor unit (10). In other words, the refrigeration apparatus (1) may include a common suction pipe through which a refrigerant in each of the utilization-side units flows into a compression unit of the heat source-side unit. In the refrigeration apparatus (1), in a case where some of the utilization-side units make a thermo-off request, whereas the remaining utilization-side units make no thermo-off request, normally, the outdoor unit (10) continuously operates the compression unit (20) without stopping the compression unit (20). However, when the pressure at the gas-liquid separator (15) is equal to or more than the critical pressure of the refrigerant, the outdoor unit (10) stops the compression unit (20). At this time, in order to reduce the pressure of the refrigerant below the critical pressure, the outdoor unit (10) opens the degassing valve (39) on the degassing pipe (37) connected to the gas-liquid separator (15). In a case where all the utilization-side units make a thermo-off request, the outdoor unit (10) stops the compression unit (20) on condition that the pressure at the gas-liquid separator (15) is equal to or more than the critical pressure. Also in this case, the outdoor unit (10) may open the degassing valve (39) for reducing the pressure of the refrigerant below the critical pressure.

In the foregoing embodiment, the outdoor unit (10) does not necessarily perform the liquid compression avoidance action. In this case, the compression unit (20) does not necessarily include the second bypass passage (22*c*) for the second compressor (22) constituting the lower stage-side compression mechanism and the third bypass passage (23*c*) for the third compressor (23) constituting the lower stage compression element. In this case, the compression unit (20) may be configured to compress the refrigerant at a single stage.

In the case where the outdoor unit (10) is configured to perform no liquid compression avoidance action, it can be considered that the outdoor unit (10) does not stop only the lower-stage compression element (22, 23), but always operates both the lower-stage compression element (22, 23) and the higher-stage compression element (21) in an integrated manner. In this case, the compression unit (20) may be a multistage compressor that includes a motor, one drive shaft coupled to the motor, a first compression mechanism (a first compression unit) coupled to the drive shaft, and a second compression mechanism (a second compression unit) coupled to the drive shaft.

The intermediate heat exchanger (17) is not limited to an air heat exchanger. For example, the intermediate heat exchanger (17) may be another heat exchanger such as a plate heat exchanger configured to cause a refrigerant to exchange heat with a heating medium such as water.

In the foregoing embodiment, the outdoor controller (101) makes a determination on the pump-down prohibition condition and performs the pump-down action and the pump-down prohibition action. Alternatively, another controller may make a determination on the pump-down prohibition condition and perform the pump-down action and the pump-down prohibition action. For example, in a system including the refrigeration apparatus (1) and a central remote controller connected to the refrigeration apparatus (1) for controlling the operations to be carried out by the refrigeration apparatus (1), a central controller of the central remote controller may perform the control described above.

In the foregoing embodiment, the refrigerant circuit is not limited as long as it performs a refrigeration cycle in which a high pressure reaches or exceeds a critical pressure of a refrigerant. In addition, a refrigerant in the refrigerant circuit is not limited to carbon dioxide.

While the embodiments and modifications have been described herein above, it is to be appreciated that various changes in form and detail may be made without departing from the spirit and scope presently or hereafter claimed. In addition, the foregoing embodiments and modifications may be appropriately combined or substituted as long as the combination or substitution does not impair the functions of the present disclosure. The foregoing ordinal numbers such as "first", "second", and "third" are merely used for distinguishing the elements designated with the ordinal numbers, and are not intended to limit the number and order of the elements.

INDUSTRIAL APPLICABILITY

As described above, the present disclosure is useful for a refrigeration apparatus.

REFERENCE SIGNS LIST

1: refrigeration apparatus
6: refrigerant circuit
10: outdoor unit (heat source-side unit)
13: outdoor heat exchanger (radiator)
15: gas-liquid separator (refrigerant storage reservoir)
14: outdoor expansion valve (heat source-side expansion mechanism)
17: intermediate heat exchanger
20: compression unit
21: first compressor (higher-stage compression element)
23: third compressor (lower-stage compression element)
23*a*: third suction pipe
23*b*: third discharge pipe
23*c*: third bypass passage
50: indoor unit (utilization-side unit)
53: indoor expansion valve (utilization-side expansion mechanism)
100: controller (control unit)

The invention claimed is:

1. A refrigeration apparatus comprising:
a refrigerant circuit including
a heat source-side unit installed outdoors, the heat source-side unit including a heat exchanger and a refrigerant storage reservoir, and
a utilization-side unit connected to the heat source-side unit,
the refrigerant circuit being configured to perform a refrigeration cycle in which a high pressure reaches or exceeds a critical pressure of the refrigerant; and
a controller configured to control an action of the refrigerant circuit and to perform
a first action of recovering at least a part of the refrigerant from the utilization-side unit and returning the refrigerant thus recovered to the heat source-side unit in a case where a stop condition of the utilization-side unit is satisfied, and
a second action of prohibiting the first action in a case where a first condition indicating that a pressure at the refrigerant storage reservoir of the heat source-side unit is equal to or more than the critical pressure of the refrigerant is satisfied.

2. The refrigeration apparatus according to claim 1, wherein
the controller determines that the first condition is satisfied, in a case where the first condition indicating that the pressure at the refrigerant storage reservoir is equal to or more than the critical pressure of the refrigerant is satisfied due to that an outside temperature is higher than a predetermined temperature.

3. The refrigeration apparatus according to claim 1, wherein
the controller determines that the first condition is satisfied, in a case where the first condition indicating that the pressure at the refrigerant storage reservoir is equal to or more than the critical pressure of the refrigerant is satisfied due to that the high pressure at the refrigerant circuit has a value more than a predetermined value.

4. The refrigeration apparatus according to claim 1, wherein
the utilization-side unit includes a utilization-side expansion mechanism having an opening degree that is adjustable, and
the controller closes the utilization-side expansion mechanism in performing the first action.

5. The refrigeration apparatus according to claim 1, wherein
the utilization-side unit includes a utilization-side expansion mechanism having an opening degree that is adjustable, and
the controller opens the utilization-side expansion mechanism in performing the second action.

6. The refrigeration apparatus according to claim 1, wherein
the heat source-side unit further includes a heat source-side expansion mechanism having an opening degree that is adjustable, the heat source-side expansion mechanism being disposed on a refrigerant path between the heat exchanger and the refrigerant storage reservoir, and
the controller adjusts the opening degree of the heat source-side expansion mechanism such that a pressure of the refrigerant stored in the refrigerant storage reservoir becomes lower than the critical pressure, in performing the first action.

7. The refrigeration apparatus according to claim 2, wherein the heat source-side unit further includes:

a heat source-side expansion mechanism having an opening degree that is adjustable, the heat source-side expansion mechanism being disposed on a refrigerant path between the heat exchanger and the refrigerant storage reservoir, and the controller adjusts the opening degree of the heat source-side expansion mechanism such that a pressure of the refrigerant stored in the refrigerant storage reservoir becomes lower than the critical pressure, in performing the first action.

8. The refrigeration apparatus according to claim 1, wherein the heat source-side unit includes:

a compression unit including a lower-stage compression element configured to compress the refrigerant, and a higher-stage compression element configured to further compress the refrigerant compressed by the lower-stage compression element;

an intermediate heat exchanger disposed on a refrigerant path between the lower-stage compression element and the higher-stage compression element and configured to cause the refrigerant to exchange heat with a heating medium; and a bypass passage connected to a suction pipe and a discharge pipe each connected to the lower-stage compression element, for bypassing around the lower-stage compression element, and the controller performs a third operation of stopping the lower-stage compression element, operating the higher-stage compression element, and causing the intermediate heat exchanger to function as an evaporator, at startup of the compression unit after prohibiting the first action in the second action.

* * * * *